US010098491B2

(12) United States Patent
Chen

(10) Patent No.: US 10,098,491 B2
(45) Date of Patent: Oct. 16, 2018

(54) MODULAR TREE WITH LOCKING TRUNK AND LOCKING ELECTRICAL CONNECTORS

(71) Applicant: Willis Electric Co., Ltd., Taipei (TW)

(72) Inventor: Johnny Chen, Taipei (TW)

(73) Assignee: WILLIS ELECTRIC CO., LTD., Taipei (TW)

( * ) Notice: Subject to any disclaimer, the term of this patent is extended or adjusted under 35 U.S.C. 154(b) by 0 days.

(21) Appl. No.: 15/239,368

(22) Filed: Aug. 17, 2016

(65) Prior Publication Data

US 2017/0042358 A1 Feb. 16, 2017

Related U.S. Application Data

(63) Continuation of application No. 14/208,058, filed on Mar. 13, 2014, now Pat. No. 9,439,528.

(Continued)

(51) Int. Cl.

*H01R 13/64* (2006.01)
*A47G 33/06* (2006.01)

(Continued)

(52) U.S. Cl.

CPC ..... *A47G 33/06* (2013.01); *A41G 1/007* (2013.01); *F21S 4/10* (2016.01); *F21V 23/06* (2013.01);

(Continued)

(58) Field of Classification Search

CPC ..... A47G 33/06; H01R 13/64; H01R 13/6456

(Continued)

(56) References Cited

U.S. PATENT DOCUMENTS 438,310 A 10/1890 Edison
735,010 A 7/1903 Zahl (Continued)

FOREIGN PATENT DOCUMENTS

CA 1182513 A 2/1985
CN 2102058 U 4/1992

(Continued)

OTHER PUBLICATIONS

Petition for Inter Partes Review, Case IPR2016-00802, U.S. Pat. No. 9,044,056, dated Apr. 28, 2016 (73 pgs.).

(Continued)

*Primary Examiner* — Hae Moon Hyeon

(74) *Attorney, Agent, or Firm* — Christensen, Fonder, Dardi & Herbert PLLC

(57) ABSTRACT

An artificial tree that includes a first trunk body having a first elongated projection that extends axially from a first end toward a second end and forms a first keyway; a first electrical connector anchored within the first end of the first trunk body; a second trunk body, including a second elongated projection that extends axially, the second elongated projection forming a second keyway, the second elongated projection configured to be received by the first keyway; and a second electrical connector anchored within a first end of the second trunk body. The second elongated projection is received by the first keyway, and first and second electrical terminals of the first electrical connector make electrical connection with first and second electrical terminals of the second electrical connector, when the first end of the first trunk body is coupled to the first end of the second trunk body.

18 Claims, 22 Drawing Sheets

Related U.S. Application Data

(60) Provisional application No. 61/780,343, filed on Mar. 13, 2013.

(51) Int. Cl.

| | |
|---|---|
| ***F21S 4/10*** | (2016.01) |
| ***A41G 1/00*** | (2006.01) |
| ***F21V 23/06*** | (2006.01) |
| *A47G 33/12* | (2006.01) |
| *F21W 121/04* | (2006.01) |

(52) U.S. Cl.
CPC ... *A47G 2033/122* (2013.01); *F21W 2121/04* (2013.01); *Y10T 29/49117* (2015.01)

(58) Field of Classification Search
USPC ..... 439/680; 362/123
See application file for complete search history.

(56) References Cited

U.S. PATENT DOCUMENTS

| | | | | |
|---|---|---|---|---|
| 860,406 | A | | 7/1907 | McGahan |
| 1,314,008 | A | | 8/1919 | McWilliams |
| 1,495,695 | A | | 5/1924 | Karr |
| 1,536,332 | A | | 5/1925 | Dam |
| 1,656,148 | A | | 1/1928 | Harris |
| 1,677,972 | A | | 7/1928 | Marks |
| 1,895,656 | A | | 1/1933 | Gadke |
| 1,974,472 | A | | 9/1934 | Seghers |
| 2,025,189 | A | | 12/1935 | Yanchenko |
| 2,050,364 | A | | 8/1936 | Morton |
| 2,072,337 | A | | 3/1937 | Kamm |
| 2,112,281 | A | | 3/1938 | Ferris |
| 2,186,351 | A | | 1/1940 | Stojaneck |
| 2,188,529 | A | | 1/1940 | Corina |
| 2,466,499 | A | | 4/1949 | Sokolik |
| 2,484,596 | A | | 10/1949 | Waltz |
| 2,533,374 | A | | 12/1950 | Hyland |
| 2,563,713 | A | | 8/1951 | Frei et al. |
| 2,570,751 | A | | 10/1951 | Benander |
| 2,636,069 | A | | 4/1953 | Gilbert |
| 2,782,296 | A | | 2/1957 | Walter |
| 2,806,938 | A | | 9/1957 | Henry |
| 2,857,506 | A | | 10/1958 | Minteer |
| 2,863,037 | A | | 12/1958 | Johnstone |
| 2,932,811 | A | | 4/1960 | Abraham et al. |
| 2,969,456 | A | | 1/1961 | Raymaley |
| 2,973,546 | A | | 3/1961 | Roche |
| 2,984,813 | A | | 5/1961 | Bossi |
| 3,107,966 | A | | 10/1963 | Bonhomme |
| 3,115,435 | A | | 12/1963 | Abramson |
| 3,118,617 | A | | 1/1964 | Hellrich |
| 3,120,351 | A | | 2/1964 | Kirsten |
| 3,131,112 | A | | 4/1964 | Abramson |
| 3,214,579 | A | | 10/1965 | Pacini |
| 3,233,207 | A | | 2/1966 | Ahroni et al. |
| 3,286,088 | A | | 11/1966 | Ahroni |
| 3,296,430 | A | | 1/1967 | Eckert |
| 3,345,482 | A | | 10/1967 | Lou |
| 3,398,260 | A | | 8/1968 | Martens |
| 3,470,527 | A | | 9/1969 | Bonhomme |
| 3,504,169 | A | | 3/1970 | Freeburger |
| 3,521,216 | A | | 7/1970 | Tolegian |
| 3,522,579 | A | | 8/1970 | Matsuya |
| 3,571,586 | A | | 3/1971 | Duckworth |
| 3,574,102 | A | | 4/1971 | Hermanson |
| 3,585,564 | A | | 6/1971 | Skjervoll |
| 3,594,260 | A | | 7/1971 | Dieffenbach |
| 3,603,780 | A | | 9/1971 | Lu |
| 3,616,107 | A | | 10/1971 | Kershner |
| 3,617,732 | A | | 11/1971 | Fisher |
| 3,640,496 | A | | 2/1972 | Duncan |
| 3,663,924 | A | | 5/1972 | Gerlat |
| 3,704,366 | A | | 11/1972 | Korb et al. |
| 3,715,708 | A | | 2/1973 | Lloyd et al. |
| 3,728,787 | A | | 4/1973 | McDonough |
| 3,764,862 | A | | 10/1973 | Jankowski |
| 3,783,437 | A | | 1/1974 | Graff et al. |
| 3,806,399 | A | | 4/1974 | Cocjin |
| 3,812,380 | A | | 5/1974 | Davis, Jr. |
| 3,819,459 | A | | 6/1974 | Wren |
| 3,914,786 | A | | 10/1975 | Grossi |
| 3,970,834 | A | * | 7/1976 | Smith ..... A47G 33/06 248/435 |
| 3,971,619 | A | | 7/1976 | Rohrssen |
| 3,985,924 | A | | 10/1976 | Pritza |
| 4,012,631 | A | | 3/1977 | Creager |
| 4,020,201 | A | | 4/1977 | Miller |
| 4,045,868 | A | | 9/1977 | Ammon et al. |
| 4,072,857 | A | | 2/1978 | DeVicaris |
| 4,097,917 | A | | 6/1978 | McCaslin |
| 4,109,345 | A | | 8/1978 | Sargent et al. |
| 4,140,823 | A | | 2/1979 | Weskamp |
| 4,161,768 | A | | 7/1979 | Gauthier et al. |
| 4,245,875 | A | | 1/1981 | Shaffer et al. |
| 4,248,916 | A | | 2/1981 | Chase |
| 4,273,814 | A | | 6/1981 | Koehler |
| 4,291,075 | A | | 9/1981 | Puleo |
| 4,340,841 | A | | 7/1982 | Schupp |
| 4,343,842 | A | | 8/1982 | Chase |
| 4,437,782 | A | | 3/1984 | Geisthoff |
| 4,447,279 | A | | 5/1984 | Boisvert et al. |
| 4,451,510 | A | | 5/1984 | Boisvert et al. |
| 4,462,065 | A | | 7/1984 | Rhodes |
| 4,493,523 | A | | 1/1985 | Leong et al. |
| 4,496,615 | A | | 1/1985 | Huang |
| 4,516,193 | A | | 5/1985 | Murphy |
| 4,519,666 | A | | 5/1985 | Williams et al. |
| 4,546,041 | A | | 10/1985 | Keane et al. |
| 4,573,102 | A | | 2/1986 | Norwood |
| 4,620,270 | A | | 10/1986 | Laasko |
| 4,631,650 | A | | 12/1986 | Ahroni |
| 4,659,597 | A | | 4/1987 | Lau |
| 4,675,575 | A | | 6/1987 | Smith et al. |
| 4,712,299 | A | | 12/1987 | Loewen et al. |
| 4,720,272 | A | | 1/1988 | Durand |
| 4,727,449 | A | | 2/1988 | Fleck |
| 4,753,600 | A | | 6/1988 | Williams |
| 4,759,729 | A | | 7/1988 | Kemppainen et al. |
| 4,769,579 | A | | 9/1988 | Jou |
| 4,772,215 | A | | 9/1988 | Falk |
| 4,775,922 | A | | 10/1988 | Engel |
| 4,777,573 | A | | 10/1988 | Liao |
| 4,779,177 | A | | 10/1988 | Ahroni |
| 4,789,570 | A | | 12/1988 | Maddock |
| 4,799,902 | A | | 1/1989 | Laudig et al. |
| 4,805,075 | A | | 2/1989 | Damore |
| 4,807,098 | A | | 2/1989 | Ahroni |
| 4,808,885 | A | | 2/1989 | Bausch et al. |
| 4,855,880 | A | | 8/1989 | Mancusi, Jr. |
| 4,859,205 | A | | 8/1989 | Fritz |
| 4,867,690 | A | | 9/1989 | Thumma |
| 4,870,547 | A | | 9/1989 | Crucefix |
| 4,870,753 | A | | 10/1989 | Pfeffer et al. |
| 4,894,019 | A | | 1/1990 | Howard |
| 4,899,266 | A | | 2/1990 | Ahroni |
| 4,908,743 | A | | 3/1990 | Miller |
| 4,921,426 | A | | 5/1990 | Kawasaki et al. |
| 4,934,964 | A | | 6/1990 | Mazelle |
| 5,015,510 | A | * | 5/1991 | Smith ..... A47G 33/06 211/196 |
| 5,033,976 | A | | 7/1991 | Sarian et al. |
| 5,051,877 | A | | 9/1991 | Liao |
| 5,071,362 | A | | 12/1991 | Martens et al. |
| 5,073,132 | A | | 12/1991 | Nottrott |
| 5,088,669 | A | | 2/1992 | Zinnbauer |
| 5,091,834 | A | | 2/1992 | Kao et al. |
| 5,104,608 | A | | 4/1992 | Pickering |
| 5,109,324 | A | | 4/1992 | Ahroni |
| 5,121,310 | A | | 6/1992 | Ahroni |
| 5,139,343 | A | | 8/1992 | Lin |
| 5,149,282 | A | | 9/1992 | Donato et al. |
| 5,154,508 | A | | 10/1992 | Ahroni |
| 5,213,407 | A | | 5/1993 | Eisenbraun |

(56) References Cited

U.S. PATENT DOCUMENTS 5,217,382 A 6/1993 Sparks
5,218,233 A 6/1993 Takahashi
5,281,158 A 1/1994 Lin
5,334,025 A 8/1994 Föhl
5,342,661 A 8/1994 Wilcox, II
5,349,780 A 9/1994 Dyke
5,350,315 A 9/1994 Cheng et al.
5,366,386 A 11/1994 Liao
5,380,215 A 1/1995 Huang
5,389,008 A 2/1995 Cheng et al.
5,390,463 A 2/1995 Sollner
D356,246 S 3/1995 Adams
5,409,403 A 4/1995 Falossi et al.
5,422,766 A 6/1995 Hack et al.
5,442,258 A 8/1995 Shibata
5,453,664 A 9/1995 Harris
5,455,750 A 10/1995 Davis et al.
5,456,620 A 10/1995 Kaminski
5,481,444 A 1/1996 Schultz
D367,257 S 2/1996 Buelow et al.
5,517,390 A 5/1996 Zins
5,518,425 A 5/1996 Tsai
5,536,538 A 7/1996 Hartung
5,541,818 A 7/1996 Ng et al.
5,550,720 A 8/1996 Carroll
5,559,681 A 9/1996 Duarte
5,560,975 A 10/1996 Casper
D375,483 S 11/1996 Tashiro
5,580,159 A 12/1996 Liu
5,586,905 A 12/1996 Marshall et al.
5,605,395 A 2/1997 Peng
5,607,328 A 3/1997 Joly
5,624,283 A 4/1997 Hotea
5,626,419 A 5/1997 Lin
5,639,157 A 6/1997 Yeh
5,652,032 A 7/1997 Kaczor et al.
5,653,616 A 8/1997 Hotea
5,695,279 A 12/1997 Sonnleitner et al.
5,702,262 A 12/1997 Brown et al.
5,702,268 A 12/1997 Lien et al.
5,707,136 A 1/1998 Byers
5,709,457 A 1/1998 Hara
5,712,002 A 1/1998 Reilly, III
5,720,544 A 2/1998 Shu
5,722,766 A 3/1998 Shu
5,727,872 A 3/1998 Liou
5,759,062 A 6/1998 Chen
5,775,933 A 7/1998 Chen
5,776,559 A 7/1998 Woolford
5,776,599 A 7/1998 Haluska et al.
5,785,412 A 7/1998 Wu et al.
5,788,361 A 8/1998 Lee
5,791,765 A 8/1998 Lin
5,791,940 A 8/1998 Chen et al.
5,807,134 A 9/1998 Hara
5,816,849 A 10/1998 Schmidt
5,816,862 A 10/1998 Tseng
5,820,248 A 10/1998 Ferguson
5,822,855 A 10/1998 Szczesny et al.
5,828,183 A 10/1998 Wang et al.
5,829,865 A 11/1998 Ahroni
5,834,901 A 11/1998 Shen
5,839,819 A 11/1998 Pan
5,848,838 A 12/1998 Presta
5,852,348 A 12/1998 Lin
5,854,541 A 12/1998 Chou
5,855,705 A 1/1999 Gauthier
5,860,731 A 1/1999 Martinez
5,860,830 A 1/1999 Wu
5,869,151 A 2/1999 Chong
5,878,989 A 3/1999 Allman
5,893,634 A 4/1999 Wang
5,908,238 A 6/1999 Huang
5,921,806 A 7/1999 Shuey
5,934,793 A 8/1999 Rahman
5,937,496 A 8/1999 Benoit et al.
5,938,168 A 8/1999 Adams
5,957,723 A 9/1999 Gort-Barten
5,966,393 A 10/1999 Hide et al.
5,971,810 A 10/1999 Taylor
5,979,859 A 11/1999 Vartanov et al.
6,004,006 A 12/1999 Wang
6,007,362 A 12/1999 Davis et al.
6,030,670 A 2/2000 Chang
6,053,774 A 4/2000 Lin
6,056,427 A 5/2000 Kao
6,079,848 A 6/2000 Ahroni
6,084,357 A 7/2000 Janning
6,086,395 A 7/2000 Lloyd et al.
6,095,874 A 8/2000 Quaranta
6,099,920 A 8/2000 Kao
6,111,201 A 8/2000 Drane et al.
6,113,430 A 9/2000 Wu
6,116,563 A 9/2000 Tsai
6,120,312 A 9/2000 Shu
6,123,433 A 9/2000 Chen
6,139,376 A 10/2000 Ooya et al.
6,147,367 A 11/2000 Yang et al.
6,149,448 A 11/2000 Haller et al.
6,155,697 A 12/2000 Ahroni
6,162,515 A 12/2000 Hill
6,203,169 B1 3/2001 Coushaine et al.
6,217,191 B1 4/2001 Wu et al.
6,228,442 B1 5/2001 Coco
6,241,559 B1 6/2001 Taylor
6,245,425 B1 6/2001 McCullough et al.
6,257,736 B1 7/2001 Fehrenbach
6,257,740 B1 7/2001 Gibboney, Jr.
6,257,793 B1 7/2001 Lin
6,261,119 B1 7/2001 Green
6,273,584 B1 8/2001 Wang et al.
6,283,797 B1 9/2001 Wu
6,320,327 B1 11/2001 Lavatelli et al.
6,328,593 B1 12/2001 Chang et al.
6,347,965 B1 2/2002 Pan
D454,110 S 3/2002 Andre et al.
6,354,719 B1 3/2002 Pan
6,361,368 B1 3/2002 Tseng
6,363,607 B1 4/2002 Chen et al.
6,407,411 B1 6/2002 Wojnarowski et al.
6,452,317 B1 9/2002 Tseng
6,457,839 B1 10/2002 Grandoit
6,458,435 B1 10/2002 Lai
6,514,581 B1 2/2003 Gregory
6,533,437 B1 3/2003 Ahroni
6,541,800 B2 4/2003 Barnett et al.
6,544,070 B1 4/2003 Radliff
6,571,340 B1 5/2003 Lee
6,576,844 B1 6/2003 Kamata
6,580,182 B2 6/2003 Janning
6,588,914 B1 7/2003 Tang
6,592,094 B1 7/2003 Kao
6,595,657 B1 7/2003 Shieh
D478,310 S 8/2003 Andre et al.
6,609,814 B2 8/2003 Ahroni
6,623,291 B1 9/2003 Tsai
6,634,766 B1 10/2003 Gordon
6,644,836 B1 11/2003 Adams
D483,721 S 12/2003 Kim et al.
6,666,734 B2 12/2003 Fukatsu
6,672,750 B1 1/2004 Kao
D486,385 S 2/2004 Smith-Kielland et al.
6,733,167 B1 5/2004 Kao
6,752,512 B2 6/2004 Pan
6,774,549 B2 8/2004 Tsai et al.
6,794,825 B1 9/2004 Kao
6,805,463 B2 10/2004 Shieh
6,824,293 B2 11/2004 Chang
6,830,358 B2 12/2004 Allen
6,840,655 B2 1/2005 Shen
6,840,802 B2 1/2005 Shepherd
6,866,394 B1 3/2005 Hutchins et al.
6,869,316 B2 3/2005 Hinkle et al.
6,883,951 B2 4/2005 Wu

(56) References Cited

U.S. PATENT DOCUMENTS 6,884,083 B2 4/2005 Shepherd
6,908,215 B2 6/2005 Wu
6,929,383 B1 8/2005 Janning
D509,797 S 9/2005 Milan
6,942,355 B1 9/2005 Castiglia
6,951,405 B2 10/2005 Yao
6,962,498 B2 11/2005 Kohen
7,021,598 B2 4/2006 Kao
7,029,145 B2 4/2006 Frederick
7,045,965 B2 5/2006 Li et al.
7,052,156 B2 * 5/2006 Primeau ..... A47G 33/06 362/123
7,055,980 B2 6/2006 Wu
7,055,981 B2 6/2006 Yao
7,066,628 B2 6/2006 Allen
7,066,739 B2 6/2006 McLeish
7,108,514 B2 9/2006 Chen et al.
D530,277 S 10/2006 Lin
7,132,139 B2 11/2006 Yang
7,144,610 B1 12/2006 Estes et al.
7,145,105 B2 12/2006 Gaulard
7,147,518 B2 12/2006 Marechal et al.
7,192,303 B2 3/2007 Kohen
7,204,720 B1 4/2007 Shiu
7,207,844 B2 4/2007 Peng
7,235,815 B2 6/2007 Wang
7,253,556 B1 8/2007 Gibboney
7,253,714 B1 8/2007 Tsui
7,264,392 B2 9/2007 Massabki et al.
7,270,450 B2 9/2007 Chan
7,311,566 B2 12/2007 Dent
7,315,692 B2 1/2008 Chow
7,318,744 B2 1/2008 Kuo
7,326,091 B2 2/2008 Nania et al.
7,393,019 B2 7/2008 Taga et al.
7,422,489 B1 9/2008 Tseng
D580,355 S 11/2008 Hussaini et al.
7,445,824 B2 11/2008 Leung et al.
7,453,194 B1 11/2008 Gibboney
D582,846 S 12/2008 Lett
7,462,066 B2 12/2008 Kohen
D585,384 S 1/2009 Andre et al.
7,473,024 B2 1/2009 Gibboney
7,527,508 B1 5/2009 Lee et al.
7,554,266 B1 6/2009 Chen
D598,374 S 8/2009 Sasada
7,575,362 B1 8/2009 Hsu
7,581,870 B2 9/2009 Massabki et al.
7,585,187 B2 9/2009 Daily et al.
7,585,552 B2 9/2009 Meseke
7,609,006 B2 10/2009 Gibboney
D608,685 S 1/2010 Krize
7,652,210 B2 1/2010 White
D609,602 S 2/2010 Krize
D611,409 S 3/2010 Green et al.
7,695,298 B2 4/2010 Arndt et al.
7,893,627 B2 2/2011 Li
D638,355 S 5/2011 Chen
8,007,129 B2 8/2011 Yang
8,053,042 B1 11/2011 Loomis
8,062,718 B2 11/2011 Schooley
8,100,546 B2 1/2012 Lutz et al.
8,132,360 B2 3/2012 Jin et al.
8,132,649 B2 3/2012 Rogers
8,298,633 B1 10/2012 Chen
8,348,466 B2 1/2013 Plumb et al.
8,450,950 B2 5/2013 McRae
8,454,186 B2 6/2013 Chen
8,454,187 B2 6/2013 Chen
8,469,734 B2 6/2013 Chen
8,469,750 B2 6/2013 Chen
D686,523 S 7/2013 Chen
8,534,186 B2 9/2013 Glucksman et al.
8,562,175 B2 10/2013 Chen
8,568,015 B2 10/2013 Chen
8,569,960 B2 10/2013 Chen
8,573,548 B2 11/2013 Kuhn et al.
8,592,845 B2 11/2013 Chen
D696,153 S 12/2013 Chen
8,608,342 B2 12/2013 Chen
8,853,721 B2 10/2014 Chen
8,863,416 B2 10/2014 Leung et al.
8,870,404 B1 10/2014 Chen
8,876,321 B2 11/2014 Chen
8,916,242 B2 12/2014 Fu et al.
8,936,379 B1 1/2015 Chen
8,959,810 B1 2/2015 Leung et al.
8,974,072 B2 3/2015 Chen
9,044,056 B2 6/2015 Chen
9,055,777 B2 6/2015 Chen
9,066,617 B2 6/2015 Chen
9,157,587 B2 10/2015 Chen
9,179,793 B2 11/2015 Chen
9,220,361 B1 12/2015 Chen
9,222,656 B2 12/2015 Chen
9,439,528 B2 * 9/2016 Chen ..... A47G 33/06
9,441,800 B1 * 9/2016 Chen ..... F21V 33/00
9,572,446 B2 * 2/2017 Chen ..... A47G 33/06
9,593,831 B2 * 3/2017 Yu ..... F21V 23/06
2002/0002015 A1 1/2002 Mochizuki et al.
2002/0097573 A1 7/2002 Shen
2002/0109989 A1 8/2002 Chuang
2002/0118540 A1 8/2002 Ingrassia
2002/0149936 A1 10/2002 Mueller et al.
2003/0096542 A1 5/2003 Kojima
2003/0142494 A1 7/2003 Ahroni
2003/0198044 A1 10/2003 Lee
2003/0198048 A1 10/2003 Frederick
2003/0206412 A1 11/2003 Gordon
2003/0218412 A1 11/2003 Shieh
2004/0004435 A1 1/2004 Hsu
2004/0012950 A1 1/2004 Pan
2004/0090770 A1 * 5/2004 Primeau ..... F21S 4/10 362/123
2004/0096596 A1 5/2004 Palmer, III et al.
2004/0105270 A1 6/2004 Shieh
2004/0115984 A1 6/2004 Rudy et al.
2004/0145916 A1 7/2004 Wu
2004/0161552 A1 8/2004 Butts, Jr.
2004/0182597 A1 9/2004 Smith et al.
2005/0048226 A1 3/2005 Gary et al.
2005/0077525 A1 4/2005 Lynch et al.
2005/0122723 A1 6/2005 Frederick
2005/0249892 A1 11/2005 Rocheleau
2005/0286267 A1 12/2005 Wang
2006/0000634 A1 1/2006 Arakawa
2006/0048397 A1 3/2006 King et al.
2006/0146578 A1 7/2006 Kuo
2006/0164834 A1 7/2006 Kao
2006/0270250 A1 11/2006 Allen
2006/0274556 A1 12/2006 Massabki et al.
2007/0091606 A1 4/2007 Reed
2007/0092664 A1 4/2007 Chun
2007/0177402 A1 8/2007 Wu
2007/0230174 A1 10/2007 Hicks et al.
2007/0253191 A1 11/2007 Chin et al.
2008/0007951 A1 1/2008 Chan
2008/0025024 A1 1/2008 Yu
2008/0107840 A1 5/2008 Leung et al.
2008/0149791 A1 6/2008 Bradley
2008/0186731 A1 8/2008 Graham
2008/0186740 A1 8/2008 Huang et al.
2008/0205020 A1 8/2008 Vich
2008/0296604 A1 12/2008 Chou et al.
2008/0303446 A1 12/2008 Ding
2008/0307646 A1 12/2008 Zaderej et al.
2009/0002991 A1 1/2009 Huang
2009/0023315 A1 1/2009 Pfeiffer
2009/0059578 A1 3/2009 Lau
2009/0213620 A1 8/2009 Lee
2009/0260852 A1 10/2009 Schaffer
2009/0289560 A1 11/2009 Oliva
2010/0000065 A1 1/2010 Cheng et al.
2010/0053991 A1 3/2010 Boggs

(56) References Cited

U.S. PATENT DOCUMENTS

| | | | | |
|---|---|---|---|---|
| 2010/0067242 | A1 | 3/2010 | Fung | |
| 2010/0072747 | A1 | 3/2010 | Krize | |
| 2010/0099287 | A1 | 4/2010 | Colburn et al. | |
| 2010/0136808 | A1 | 6/2010 | Vanzo | |
| 2010/0159713 | A1 | 6/2010 | Nishihira et al. | |
| 2010/0195332 | A1 | 8/2010 | Wasem | |
| 2010/0196628 | A1 | 8/2010 | Shooley | |
| 2010/0263911 | A1 | 10/2010 | Watanabe | |
| 2011/0062875 | A1 | 3/2011 | Altamura | |
| 2011/0076425 | A1 | 3/2011 | Cheng et al. | |
| 2011/0256750 | A1 | 10/2011 | Chen | |
| 2012/0009360 | A1 | 1/2012 | Fu et al. | |
| 2013/0108808 | A1 | 5/2013 | Leung et al. | |
| 2013/0163231 | A1* | 6/2013 | Chen | F21V 33/00 362/123 |
| 2013/0301245 | A1 | 11/2013 | Chen | |
| 2013/0308301 | A1 | 11/2013 | Chen | |
| 2013/0309908 | A1 | 11/2013 | Sandoval et al. | |
| 2014/0087094 | A1 | 3/2014 | Leung et al. | |
| 2014/0215864 | A1 | 8/2014 | Fischer, Jr. et al. | |
| 2014/0268689 | A1 | 9/2014 | Chen | |
| 2014/0287618 | A1 | 9/2014 | Chen | |
| 2014/0334134 | A1 | 11/2014 | Loomis | |
| 2015/0029703 | A1 | 1/2015 | Chen | |
| 2015/0070878 | A1* | 3/2015 | Yu | F21V 23/06 362/123 |
| 2015/0157159 | A1 | 6/2015 | Leung et al. | |
| 2015/0272250 | A1 | 10/2015 | Chen | |
| 2016/0021957 | A1 | 1/2016 | Chen | |
| 2016/0021958 | A1 | 1/2016 | Chen | |
| 2016/0033097 | A1 | 2/2016 | Chen | |

FOREIGN PATENT DOCUMENTS

| | | | |
|---|---|---|---|
| CN | 2242654 | Y | 12/1996 |
| CN | 1181693 | | 5/1998 |
| CN | 2332290 | Y | 8/1999 |
| CN | 2484010 | Y | 4/2002 |
| CN | 1509670 | A | 7/2004 |
| CN | 2631782 | Y | 8/2004 |
| CN | 2751226 | Y | 1/2006 |
| CN | 100409504 | C | 9/2007 |
| CN | 100409506 | C | 8/2008 |
| CN | 201187701 | Y | 1/2009 |
| CN | 201829727 | U | 5/2011 |
| CN | 102224645 | A | 10/2011 |
| DE | 8436328 | | 4/1985 |
| DE | 10235081 | A1 | 2/2004 |
| EP | 434425 | A1 | 6/1991 |
| EP | 0552741 | | 7/1993 |
| EP | 0342050 | B1 | 8/1995 |
| EP | 0727842 | | 8/1996 |
| EP | 895742 | B1 | 2/1999 |
| EP | 0920826 | A1 | 6/1999 |
| EP | 1 049 206 | A2 | 11/2000 |
| EP | 1763115 | A2 | 3/2007 |
| EP | 2533374 | A1 | 12/2012 |
| FR | 1215214 | | 4/1960 |
| GB | 1150390 | | 4/1969 |
| GB | 1245214 | | 9/1971 |
| GB | 2112281 | A | 7/1983 |
| GB | 2137086 | A | 10/1984 |
| GB | 2 169 198 | A | 7/1986 |
| GB | 2172135 | A | 9/1986 |
| GB | 2178910 | A | 2/1987 |
| GB | 2208336 | A | 3/1989 |
| GB | 2221104 | A | 1/1990 |
| GB | 2396686 | A | 6/2004 |
| JP | H11121123 | A | 4/1999 |
| WO | WO 91/10093 | | 7/1991 |
| WO | WO 96/24966 | | 8/1996 |
| WO | WO 96/26661 | A1 | 9/1996 |
| WO | WO 2004/008581 | A1 | 1/2004 |
| WO | WO 2007140648 | A1 | 12/2007 |
| WO | WO 2009/115860 | A1 | 9/2009 |

OTHER PUBLICATIONS

Petition for Inter Partes Review, Case IPR2016-00801, U.S. Pat. No. 8,454,187, dated Apr. 18, 2016 (69 pgs.).

Petition for Inter Partes Review, Case IPR2016-00800, U.S. Pat. No. 8,454,186, dated Apr. 18, 2016 (78 pgs.).

U.S. Appl. No. 12/157,136, filed Jun. 5, 2008, inventor Johnny Chen.

U.S. Application No. 90/012,209, filed Mar. 26, 2012, inventor Johnny Chen.

U.S. Application No. 90/020,074, filed Jul. 14, 2014, U.S. Pat. No. 8,454,187.

U.S. Application No. 90/020,073 filed Jul. 7, 2014, U.S. Pat. No. 8,454,186.

Petition for Inter Partes Review of U.S. Pat. No. 8,454,187, Case No. IPR2014-01264, filed Aug. 8, 2014, available at https://ptabtrials.uspto.gov.

Petition for Inter Partes Review of U.S. Pat. No. 8,454,186, Case No. IPR2014-01263, filed Aug. 8, 2014, available at https://ptabtrials.uspto.gov.

U.S. Appl. No. 14/851,148, filed Sep. 11, 2015, Inventor Johnny Chen.

U.S. Appl. No. 14/970,118, filed Dec. 15, 2015, Inventor Johnny Chen.

U.S. Appl. No. 15/150,252, filed May 9, 2016, Inventors Alec Hwa et al.

* cited by examiner

500
A
161
234
516
514
230
231
233
225
522
223
512
510
222
232
504
502
6A
121
501
503
520
506
508
7A
505
507
9

550
161
234
516
516
230
231
233
512
512
222
232
504
502
504
121

550
121
232
512
512
222
516
520
516
230
234
508
506
508
161

550
161
13
13
504
13
13
121

550
161
506
506
508
508
231
233
225
223
504
504
502
502
121

500a
161
516a
234
514
230
225
223
512a
222
232
502a
504a
121
500a
121
232
512a
222
516a
230
234
506a
508d
161
500a
161
17
17
504a
17
17
121
500a
161
506a
231
233
508a
225
223
504a
502a
121

550a
234
516a
516a
514
230
225
223
512a
512a
222
232
504a
504a
502a
502a
121

550a
121
232
512a
512a
222
516a
516a
230a
234
508a
508a
506a 550a
161
21
21
504a
21
21
121

550a
161
234a
234b
506a
506a
508a
508a
231
233
225
223
504a
504a
502a
502a
232a
232b 500b
161
568
234
562
514
230
560
232
566
564
121

500b
121
564
232
560
222
562
234
570
568
161

500b
161
24
24
24
24
121

500b
161
121

500c
161
568b
234
562b
514
230
560b
232
566b
564b
121

500c
161
564b
232
560b
222
562b
234
570b
568b
161

500c
161
28
28
121

500c
161
121

500d
161
234
230
512d
222
232
502d
504d
121
516d
508d
32

A
600
161
620
622
234
230
640
643
642
646
634
630
222
632
232
602
604
606
608
121
121
232
222
656
654
652
658
650
230
234
626
620
38A
38A
624
622
161
628
A
161
40
40
624
40
40
602
604
606
121
161
206
230
658
656
640
644
642
634
646
222
204
121
624
161

A
650
234
230
640
643
642
646
634
630
222
632
232
602
604
606a
608
121

A
650
232
222
654
656
652
658
650
230
234
624b
626
620
624a
161
628

650
161
44
44
624a
44
44
602
604
606a
121

650
161
230
658
656
624b
640
644
642
646
222
606b
204
121

A
670
624
234
230
222
232
602
604
606
608

A
670
606
232
222
230
234
624
161

670
161
48
48
624
222
48
48
602
604
606

670
161
604
121

A
670a
624
234
230
222
232
604
606a

A
670a
606a
232
222
230
234
624b
624a 670a
161
52
52
624
222
52
52
604
606a
121

670a
161
624
670a
606b
121

A
161
700
234
230
225
708
710
223
704
706
222
702
232
604
608
121
121
604
232
222
700
728
724
233
231
722
726
720
234
607
605
161
161
56
56
700
708
222
56
56
604
121
A
206
230
233
231
161
700
604
222
204
121

760
161
234
230
764
762
222
232
609
602
604
121

760
121
232
222
766
231
233
768
230
234
161

760
161
60
60
711
222
60
60
604
121

760
206
766
230
233
231
161
225
223
711
222
204
121

A
161
780
234
230
231
233
223
764
784
225
222
232
609
602
604
121
A 121
780
232
222
231
768
782
233
230
234
161

161
64
64
780
222
784
64
64
604
121

206
230
231
233
780
225
223
222
204

MODULAR TREE WITH LOCKING TRUNK AND LOCKING ELECTRICAL CONNECTORS

CROSS-REFERENCE TO RELATED APPLICATIONS

The present application is a continuation of U.S. patent application Ser. No. 14/208,058, filed Mar. 13, 2014, which claims the benefit of U.S. Provisional Application No. 61/780,343 filed Mar. 13, 2013, both of which are hereby incorporated by reference herein in their entireties.

FIELD OF THE INVENTION

The present invention is generally directed to artificial trees. More specifically, the present invention is directed to artificial trees having separable, modular tree portions mechanically and in some cases, electrically, connectable between trunk portions.

BACKGROUND OF THE INVENTION

Artificial, decorative trees, such as Christmas trees, generally require some assembly by a user. One common type of artificial tree includes a base and one to four tree sections that are joined together at the trunk. An end of the trunk portion of the first tree section is firstly inserted into the tree base. The user then inserts an end of the trunk portion of the second tree section into the other end of the trunk portion of the first tree section, and so on, until all tree sections are stacked atop one another and the tree is completely assembled.

Avoiding rotation, or twisting of the tree sections can be desirable from an aesthetic standpoint. For example, after a tree is decorated with ornaments and light strings, and perhaps with one side facing a wall, a user would prefer that the tree sections not be rotated about one another so as to preserve the appearance of the decorated, perhaps lit, tree.

In addition to maintaining aesthetic appearances, for pre-lit artificial trees having light strings already attached to the tree sections, and especially for those having wiring extending between trunk sections, it can be particularly useful to avoid rotation of the tree sections about one another. For some designs, if a tree section rotates or twists relative to another, light string wiring can be damaged.

Known solutions for preventing rotation of individual tree sections at the trunk ends range from a simple solution such as ensuring a tight interference fit between trunk ends to using mechanical couplers between tree sections. However, some such designs can be ineffective, or difficult to implement with lighted, artificial trees employing wiring within the individual trunk sections.

SUMMARY OF THE INVENTION

In an embodiment, the invention comprises an artificial tree defining a central vertical axis, the tree comprising: a first trunk body, including a first end and a second end, the first end including a first elongated projection that extends axially from the first end toward the second end, the first elongated rib forming a first keyway; a first electrical connector anchored within the first end of the first trunk body, the first electrical connector including a first electrical terminal and a second electrical terminal; a second trunk body, including a first end and a second end, the first end including a second elongated projection that extends axially from the first end toward the second end, the second elongated projection forming a second keyway, the second elongated projection configured to be received by the first keyway; a second electrical connector anchored within the first end of the second trunk body, the second electrical connector including a first electrical terminal and a second electrical terminal; wherein the second elongated projection is received by the first keyway, the first electrical terminal of the first electrical connector makes electrical connection with the first electrical terminal of the second electrical connector, and the second electrical terminal of the first electrical connector makes electrical connection with the second electrical terminal of the second electrical connector, when the first end of the first trunk body is coupled to the first end of the second trunk body.

In another embodiment, the invention comprises an artificial tree defining a central vertical axis, the tree comprising: a first trunk body, including a first end and a second end, the first end having a diameter that is less than a diameter of the second end, the first end including a convex projection extending radially outward from the first end; a first electrical connector anchored within the first end of the first trunk body, the first electrical connector including a first electrical terminal and a second electrical terminal, the first electrical terminal aligned along the central vertical axis; a second trunk body, including a first end and a second end, the first end defining an L-shaped slot, the L-shaped slot defining a first portion extending axially from the first end toward the second end and a second a second portion transverse to the first portion, the L-shaped slot configured to receive the convex projection; and a second electrical connector anchored within the first end of the second trunk body, the second electrical connector including a first electrical terminal and a second electrical terminal, the first electrical terminal aligned along the central vertical axis; wherein the L-shaped slot receives the convex projection, the first electrical terminal of the first electrical connector makes electrical connection with the first electrical terminal of the second electrical connector, and the second electrical terminal of the first electrical connector makes electrical connection with the second electrical terminal of the second electrical connector, when the first end of the first trunk body is inserted into the first end of the second trunk body.

In another embodiment, the invention comprises an artificial tree defining a central vertical axis, the tree comprising: a first trunk body, including a first end and a second end; a first electrical connector anchored within the first end of the first trunk body, the first electrical connector including a first end, a second end, a first electrical terminal, a second electrical terminal, the second end having a diameter larger than the first end and defining a keyway; a second trunk body, including a first end and a second end; a second electrical connector anchored within the first end of the second trunk body, the second electrical connector defining a cavity for receiving the first end of the first electrical connector, the second electrical connector including a first electrical terminal, a second electrical terminal, and a key portion, the key portion configured to be received by the keyway of the first electrical connector; wherein the first end of the first electrical connector is received by the cavity of the second electrical connector, the key portion is received by the keyway, the first electrical terminal of the first electrical connector makes electrical connection with the first electrical terminal of the second electrical connector, and the second electrical terminal of the first electrical connector makes electrical connection with the second electrical terminal of the second electrical connector, when the first end of the first trunk body is coupled to the first end of the second trunk body.

BRIEF DESCRIPTION OF THE FIGURES

The invention can be understood in consideration of the following detailed description of various embodiments of the invention in connection with the accompanying drawings, in which.

Figure 1:
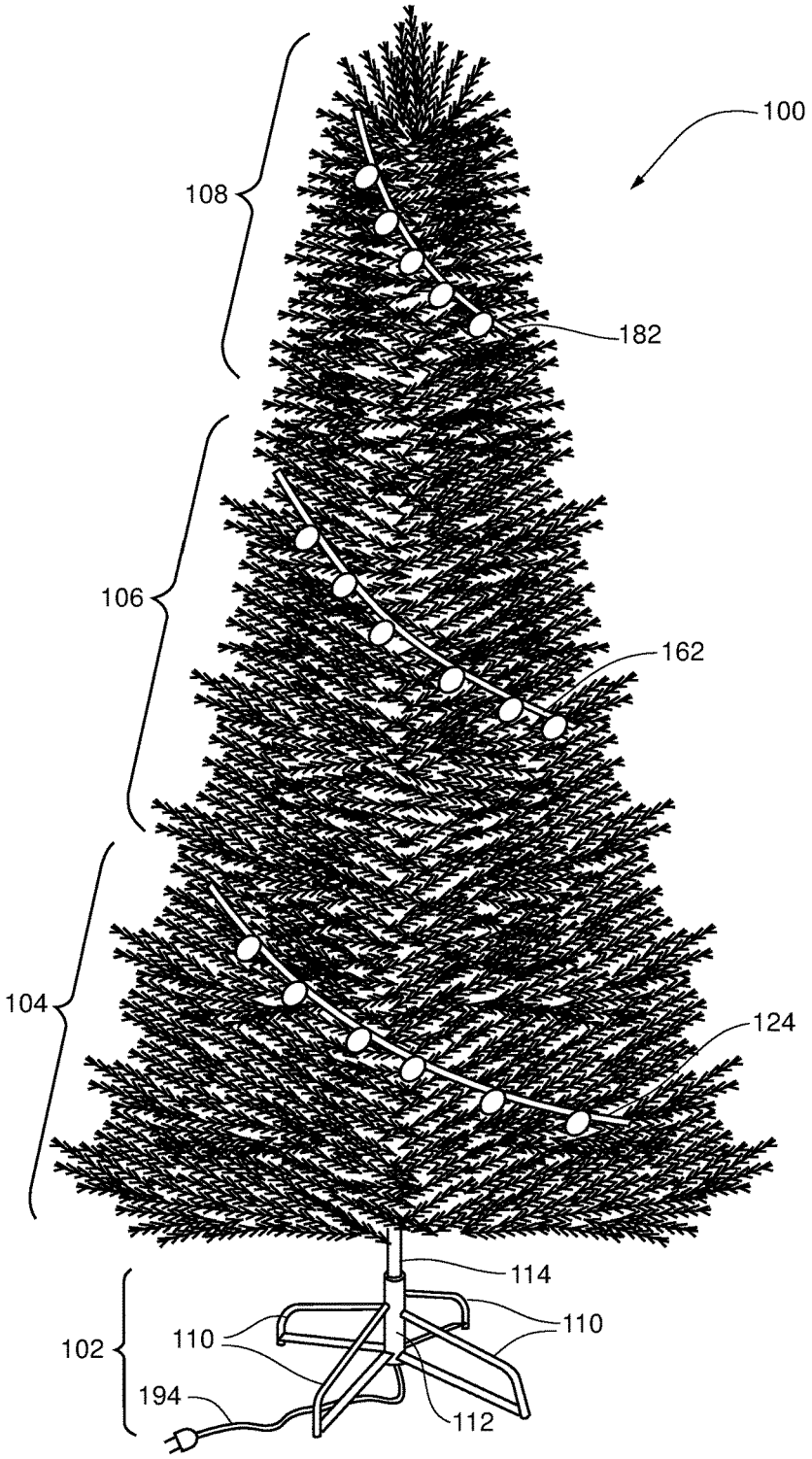
FIG. 1 is a front perspective view of a modular, lighted artificial tree, according to an embodiment of the claimed invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Referring to FIG. 1, an embodiment of modular lighted tree 100 of the present invention is depicted. Modular tree 100 includes base portion 102, first lighted tree portion 104, second lighted tree portion 106, and third lighted tree portion 108. In some embodiments, modular tree 100 may include more tree portions, such as a fourth tree portion, or may include fewer lighted tree portions. The depicted embodiment of modular tree 100 includes light strings, as described further below, but in other embodiments, modular tree 100 is not a lighted tree. When tree 100 is assembled, as depicted, tree portions 104, 106, and 108 are aligned along a common vertical axis A (see FIG. 2) and held in a generally vertical orientation by base portion 102.

Base portion 102 as depicted includes multiple legs 110 connected to a central trunk-support portion 112. As depicted, trunk support portion 112 may be generally cylindrical to receive and support first tree portion 104. Base portion 102 may include an optional base-trunk portion 114 extending upwardly from trunk support portion 112 to form a portion of a trunk of tree 100. In other embodiments, base portion 102 may comprise other configurations capable of supporting and aligning tree portions 104, 106, and 108 in a steady, upright manner. Such alternate embodiments include a base portion having more or fewer legs 110, an integrated structure with an opening for receiving first lighted tree portion 104, and other such embodiments.

Figure 2:
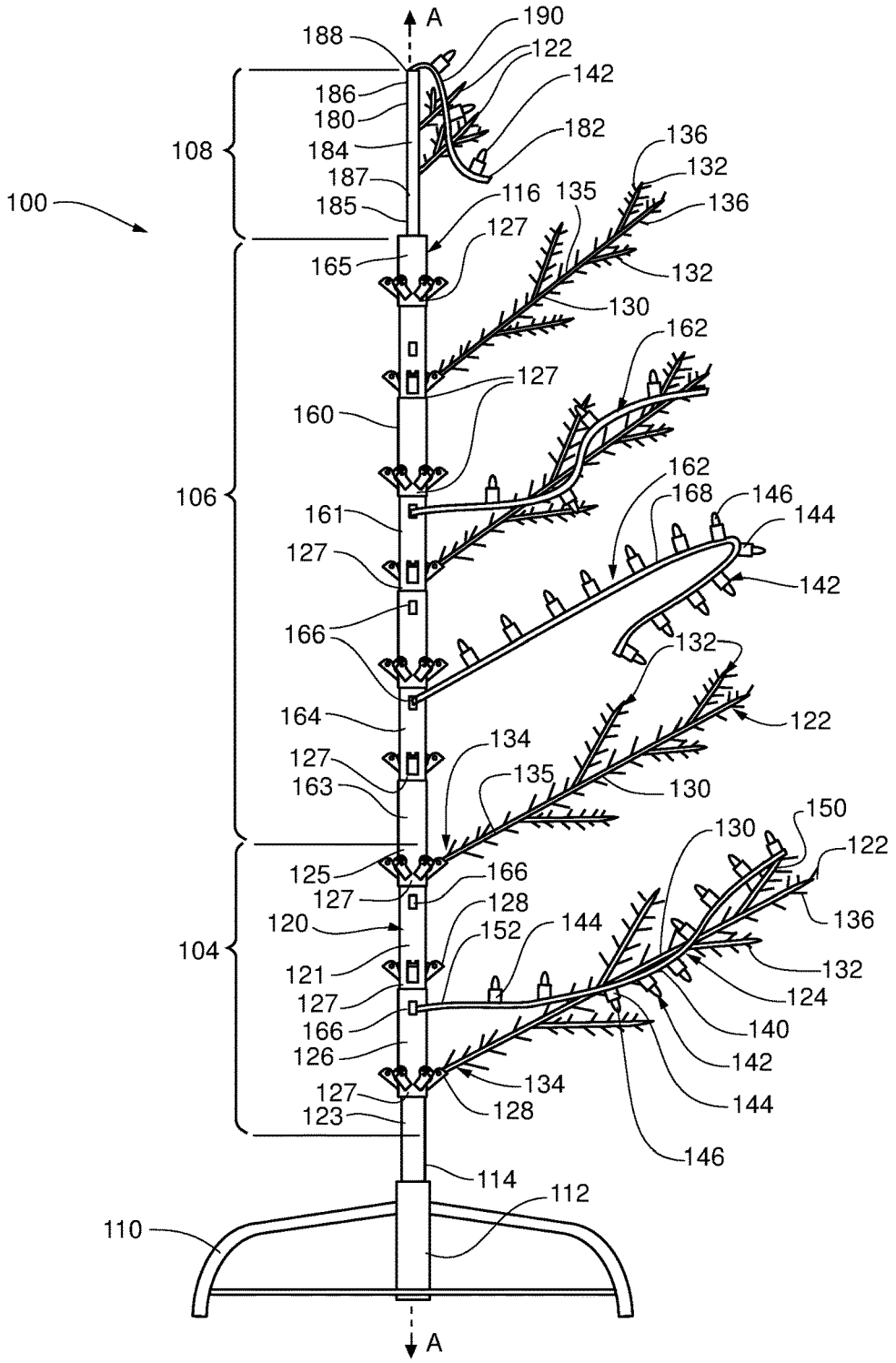
FIG. 2 is a front view of the tree of FIG. 1, with multiple branches removed.

Referring also to FIG. 2, modular tree 100 is depicted in an assembled configuration, with multiple branches and light strings removed for illustrative purposes.

As depicted, first lighted tree portion 104 includes first trunk portion 120, multiple branches 122, and one or more first light strings 124.

First trunk portion 120 as depicted comprises a generally cylindrical, hollow structure including trunk body 121 having a first end 123, second end 125, outside wall 126, and one or more branch-support rings 127. First trunk portion 120, in an embodiment, also defines multiple openings 166 in wall 126.

Branch-support rings 127 include multiple branch receivers 128 extending outwardly and away from trunk portion 120. In some embodiments, branch receivers 128 define a channel for receiving a trunk end of a branch 122.

Each branch 122 generally includes primary branch extension 130 and may also include multiple secondary branch extensions 132 extending away from branch extension 130. Branch 122 is connected to trunk portion 120 at a branch receiver 128 at trunk-end 134. In some embodiments, as depicted, branches 122 include strands 136 simulating the needles found on natural pine or coniferous trees. Strands 136 are attached to branch frame 135, which in some embodiments comprises a solid-core frame, such as a metal rod, wire, multiple twisted wires or rods, or similar such materials. In other embodiments, frame 135 may be hollow.

Trunk ends of branches 122 may be bent or otherwise formed to define a loop or circular opening such that trunk end 134 of branch 122 may be secured to branch receiver 128 by way of a pin (not depicted) extending through branch receiver 128 and the loop formed at trunk end 134 of branch 122. In this way, a branch 122 may be allowed to pivot about the pin and branch receiver 128, allowing tree portion 104 to collapse to a smaller envelope size for convenient storage. Other embodiments may employ other means to attached branches to trunk sections.

First light string 124 includes light string wiring 140 and a plurality of lighting element assemblies 142. Each lighting assembly element 142 includes housing 144 and lighting element 146. Lighting elements 146 may comprise incandescent bulbs, light-emitting diodes (LEDs), a combination thereof, or any of other known types of light-emitting elements.

As also described below with respect to FIG. 3, lighting elements 146 may be electrically connected in parallel, series, or a combination of series and parallel, to form a parallel-connected, series-connected, parallel-series connected, or series-parallel connected first light string 124.

First light string 124 is affixed to one or more branches 122 of lighted tree portion 104 via multiple clips 150. A proximal end 152 of light string 124 may be connected to outside wall 126 of first trunk portion 120 by a connector or clip as described further below, or may be inserted through an opening 166 in wall 126 into an interior space defined by first trunk portion 120.

In one embodiment, first lighted tree portion 104 includes a plurality of first light strings 124. Such first light strings 124 may be substantially the same, for example, a series-parallel connected light string having 100 lighting element assemblies 142. In other embodiments, first lighted tree portion 104 may include first light strings 124 having a particular configuration and other first light strings 124 having another, different configuration. For example, first light strings 124 located closer to base portion 102 may be longer in length with more light emitting assemblies 142, while first light strings 124 further from base portion 102 may be relatively shorter in length, with fewer light emitting assemblies 142. In other embodiments, first lighted tree portion 104 may include only a single light string 124.

Second lighted tree portion 106, adjacent first lighted tree portion 104, is similar to lighted tree portion 104 and includes second trunk portion 160, multiple branches 122 and one or more second light strings 162.

Second trunk portion 160 as depicted also comprises a generally cylindrical, hollow structure including trunk body 161 having a first end 163, a second end 165, outside wall 164, and one or more branch-support rings 127. First trunk portion 120 also defines multiple openings 166 in wall 164.

In one embodiment, trunk portion 160 may have a trunk diameter that is substantially equal to a trunk diameter of first trunk portion 120, while in other embodiments, may have a trunk diameter that is different from that of the first trunk portion. In one such embodiment, a trunk diameter of second trunk portion 160 is slightly less than a trunk diameter of first trunk portion 120 such that that trunk 116 has a somewhat tapered look.

Similar to first light strings 124, second light strings 162 may comprise any combination of series-connected, series-parallel, parallel-series, or parallel-connected individual or groupings of lighting element assemblies 142.

Third lighted tree portion 108, adjacent to second lighted tree portion 106 includes third trunk portion 180, branches 122, and one or more third light strings 182. In some embodiments, such as the depicted embodiment, a diameter of third trunk portion 180 may be somewhat smaller in diameter than a diameter of second lighted tree portion 108. As depicted, third trunk portion 180 comprises a relatively smaller diameter pipe-like body portion 184 including lower end 185, upper end 186, trunk wall 187, and defining top opening 188 (see also FIGS. 3 and 4). Also as depicted, in some embodiments, third trunk portion 180 may also not include branch-support rings 127, as branches 122 of third lighted tree portion 108 may be somewhat shorter in length than branches 122 of second lighted tree sections 106 and may be directly connected to body portion 184 of third trunk portion 180.

Third light string 182 includes wiring 190 and multiple lighting element assemblies 142. Similar to first light strings 124, third light strings 182 may comprise any combination of series-connected or parallel-connected individual or groups of lighting element assemblies 142.

In the embodiment depicted, third light string 182 emerges from top opening 188 such that a portion of third light string 182 is within an interior space defined by third trunk portion 180. Alternatively, third light string 182 may be connected via an electrical connector at opening 188. In other embodiments, third light string is mechanically connected to a trunk portion via a connector at wall 186 of third trunk portion 180, or may be received in part by an opening (not depicted) in wall 186. In yet other embodiments, third light string 182 may be an extension of second light string 162.

Figure 3:
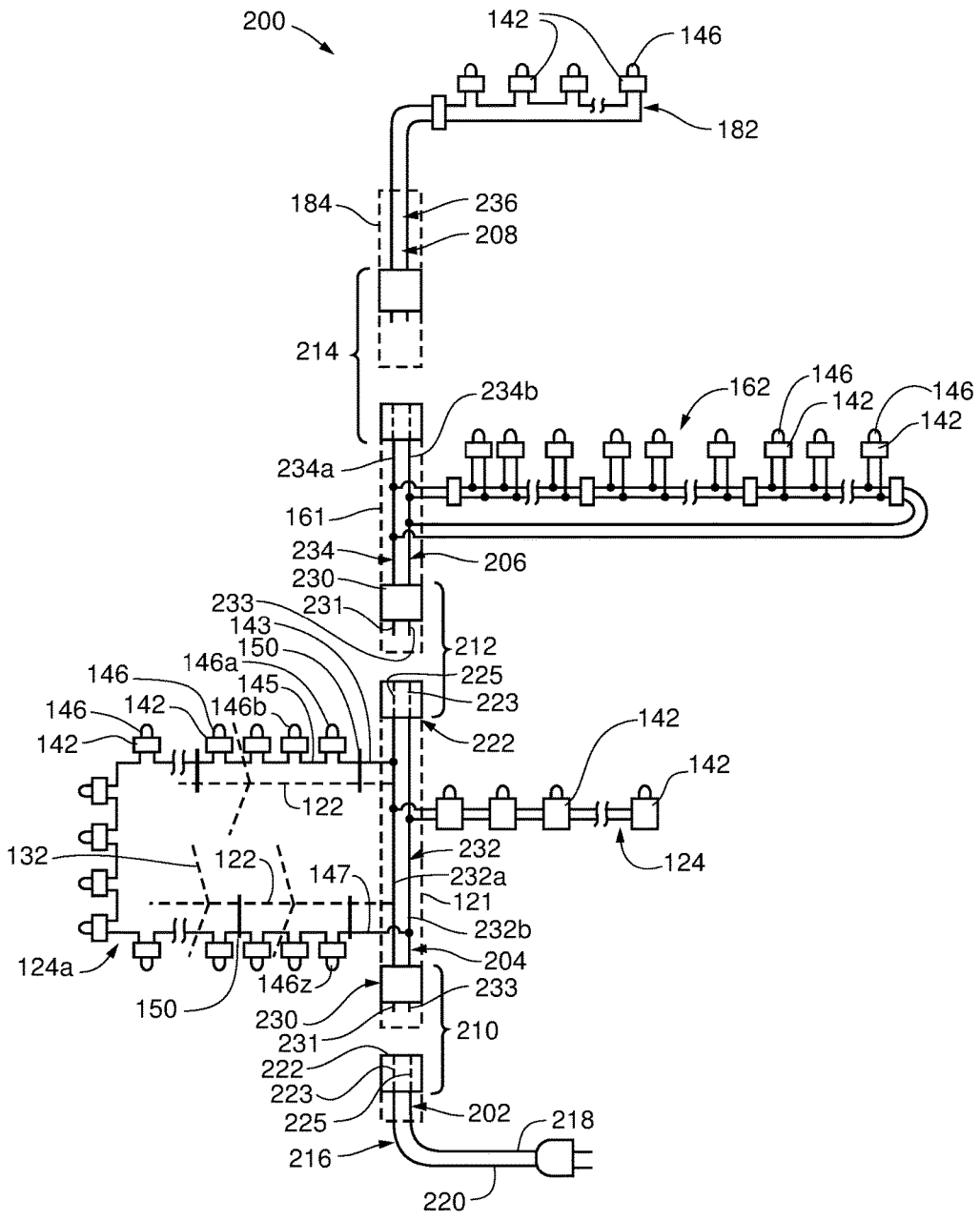
FIG. 3 is a block diagram of an electrical connection and wiring assembly of the modular, lighted artificial tree of FIG. 1.

Referring to FIG. 3, an embodiment of electrical connection and wiring harness assembly 200 is depicted. In an embodiment, electrical connection and wiring harness assembly 200 includes base portion electrical connection and wiring harness subassembly 202, first tree portion electrical connection and wiring harness subassembly 204, second tree portion electrical connection and wiring harness subassembly 206, and third electrical connection and wiring harness 208. Electrical connection and wiring harness assembly 200 also includes first electrical connector system 210, second electrical connector system 212 and third electrical connector system 214, electrically connecting base 102 to first tree portion 104, first tree portion 104 to second tree portion 106, and second tree portion 106 to third three portion 108.

In an embodiment, base electrical connection and wiring harness subassembly 202 includes power cord 216, first polarity wiring 218 having one or multiple wires, second polarity wiring 220, also having one or multiple wires, electrical connector 222, which in an embodiment is a female connector. Electrical connector 222 includes two or more electrical terminals 223 and 225 electrically connected to wires 220 and 218, respectively.

In an alternate embodiment, power cord 216 connects to wiring harness subassembly 204 and/or electrical connector 230 directly in a simplified electrical system.

First tree portion electrical connection and wiring harness subassembly 204 includes electrical connector 230, wire set 232 having first polarity wire **232*a* and second polarity wire 232*b*, and electrical connector 222. It will be understood that herein, "first polarity" and "second polarity" may define opposite polarities, such as a positive and negative polarity (or vice versa) as in the case of direct-current power transmission, or live and neutral "polarities" (or vice versa) as in the case of alternating current (AC) power transmission, or similar. In an embodiment, electrical connector 222 is substantially the same as connector 222 of base portion connector 222. In an embodiment, electrical connector 222 includes two or more electrical terminals 223 and 225 electrically connected to wires 232*a* and 232*b*, respectively. In another embodiment, the connectors differ. Electrical connector 230 in the embodiment depicted is a male electrical connector. Electrical connector 230 includes two or more terminals 231 and 233 electrically connected to wires 232*a* and 232*b***, respectively.

Second tree portion electrical connection and wiring harness subassembly 206 includes male electrical connector 230, wire set 234 having first polarity wire **234*a* and second polarity wire 243*b*, and female electrical connector 222. In an embodiment, electrical connector 222 is substantially the same as connector 222 of base portion connector 222, with terminals 223 and 225 electrically connected to wires 234*a* and 234*b*, respectively. In another embodiment, the connectors differ. Male electrical connector 230 includes electrical terminals 231 and 233 electrically connected to wires 234*a* and 234*b***, respectively.

Third tree portion electrical connection and wiring harness subassembly 208 includes electrical connector 230 and wire set 236.

It will be understood that for each male/female connecting pair 222/230 the position of each connector could be reversed such that, for example, subassembly 202 includes male connector 230 rather than female connector 222, and the male and female connectors on subassembly 204 are reversed from top to bottom.

Further embodiments of wiring harnesses, wire subassemblies, and electrical connectors are described in pending U.S. patent application Ser Ser. No. 13/112,650, published at US 2012/0076957, and entitled MODULAR LIGHTED TREE, which is incorporated by reference herein in its entirety.

When assembled, base portion electrical connection and wiring harness subassembly 202 plugs into first tree portion electrical connection and wiring harness subassembly 204, which plugs into second tree portion electrical connection and wiring harness subassembly 206, and which plugs into third electrical connection and wiring harness 208 to form tree electrical connection and wiring harness assembly 200.

When assembled, an electrical connection is formed between subassemblies 202, 204, 206, and 208 such that power may be transmitted from an external source via power cord 216 to the various wire sets 232, 234, and 236, and distributed to multiple light sets 124 of tree 100.

Still referring to FIG. 3, and with respect to the various light strings of tree 100, as described briefly above, a number of electrical configurations, using a variety of physical wiring harnesses, are possible. It will be understood that although parallel, series, series-parallel, and parallel-series light strings are depicted on a single tree 100, in embodiments, tree 100 may only include light strings of one electrical configuration type, e.g., all light strings have series connected lighting elements, or all light strings have parallel, or all have parallel-series/series-parallel.

As depicted, first light string 124 is a "parallel" configured light string, such that all lighting elements 146 of lighting assemblies 142 are electrically connected in parallel.

In another embodiment, tree 100 includes light string 124*a* which as depicted includes series-connected lighting elements 146, though in other embodiments, light string 124*a* may be a series-parallel configuration.

Light string 124*a* as depicted is a "single-wire" or single-loop light string. A first wire 143 electrically connects a first lighting element 146*a* to a first bus wire of wiring 234, and a second wire 145 connects lighting element 146*a* to lighting element 146*b*. As such, a "single" wire electrically and mechanically joins the two lighting elements 146*a* and 146*b*. A last single wire 147 connects last lighting element 146*z* to a second bus wire of wiring 234 to complete an electrical series circuit. This configuration allows first wire 143 to be connected to wiring 234 and tree portion 104 at a location different from the location that last wire 147 connects to wiring 234 and tree portion 104, if desired.

One advantage of such an embodiment, is that light string 124*a* may be distributed amongst multiple branches 130, including branches that may be at different heights along tree portion 104, branches adjacent one another at the same height, branches opposite one another, and so on, without having to bring last wire 147 back to a point close to, or adjacent to, first wire 143. However, in an embodiment, last wire 147 may be brought back to a point close to, or adjacent to, first wire 143. In an alternate embodiment not depicted, light string 124*a* spans more than one tree portion, with an electrical connector joining a first portion of the light string 124*a* (associated with first tree portion 104) and a second portion of the light string 124*a* (associated with second tree portion 106).

Figure 4A:
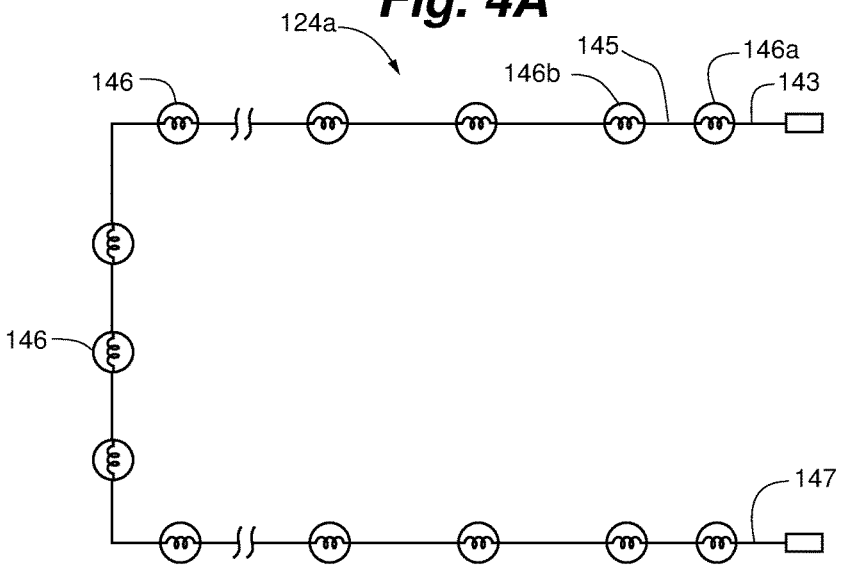
FIG. 4A depicts an electrical schematic of a "single-wire" light string, according to an embodiment of the present invention.
Figure 5:
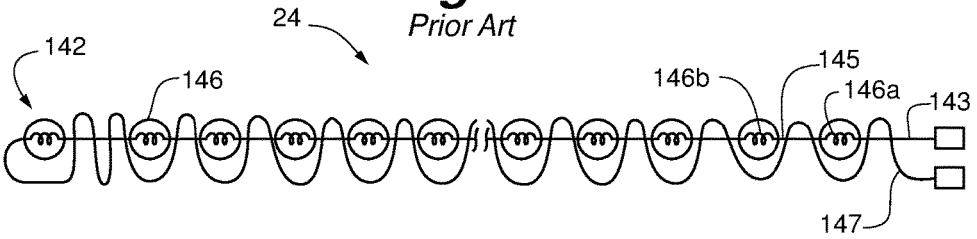
Fig. 5 Prior Art
FIG. 5 depicts a wiring layout of a "twisted-pair" light string of the prior art.

Referring to FIGS. 4A and 5, an embodiment of a single-wire construction light string 124*a* is depicted in FIG. 4, and a traditional twisted pair wire configuration is depicted in FIG. 5.

Referring specifically to FIG. 4A, light string 124*a* includes a first/lead wire 143 and a last/return wire 147. In an embodiment, none of the single wires, including first wire 143, intermediate wires 145, and last wire 147 are intertwined, or twisted together. In the embodiment depicted, first wire 143 may be located at a first location of tree 100, while last wire 147 may be located at a different location of tree 100. In an alternate embodiment, lead wire 143 may be twisted with return wire 147, but a lead or return wire is not intertwined with other intermediate wires 145.

In an embodiment, a generally non-conductive twine, false wire, or other string-like supporting portion may be intertwined with first, intermediate, and last wires to provide pull strength to light string 124*a*. In another embodiment, such as the one described with respect to FIG. 4A, no such additional string-like portion is added to single-wire light string 124*a*.

Conversely, and referring to FIG. 5, a prior art light string 24 includes a last wire 147, often referred to as an electrical "return wire", that is intertwined with the other single wires of light string 24, including first wire 143 and intermediate wires 145. The twisting of the wires between lighting elements 146 strengthens the mechanical coupling of lighting element assemblies 142. If wires between lighting element assemblies 142 (and lighting elements 146) are pulled, it is less likely that wires will be pulled out of, or disengage from, assemblies 142 when a twisted pair of wires is used in the light string.

On the other hand, a single-wire construction light string 124*a* does not have the benefit of the added strength of the twisted pair construction of the prior art. As such, it is more vulnerable to loose, damaged or removed wires. Such loosening of wires, or damage to the light string could more easily occur if tree portions, such as 104 and 106, are allowed to rotate about each other. In such a case of rotation about Axis A of one tree portion relative to another, branches from one tree portion may contact and pull on wires of a light string in another tree portion, such as branches 130 of tree portion 104 pulling or snagging a single wire of a light string 124*a* of tree portion 106.

To avoid such potential damage to single-wire light strings of the claimed invention, an anti-rotation feature embodied by locking trunk and/or locking electrical connectors prevents or limits rotation of one tree portion relative to another tree portion, as will be described further below.

Figure 4B:
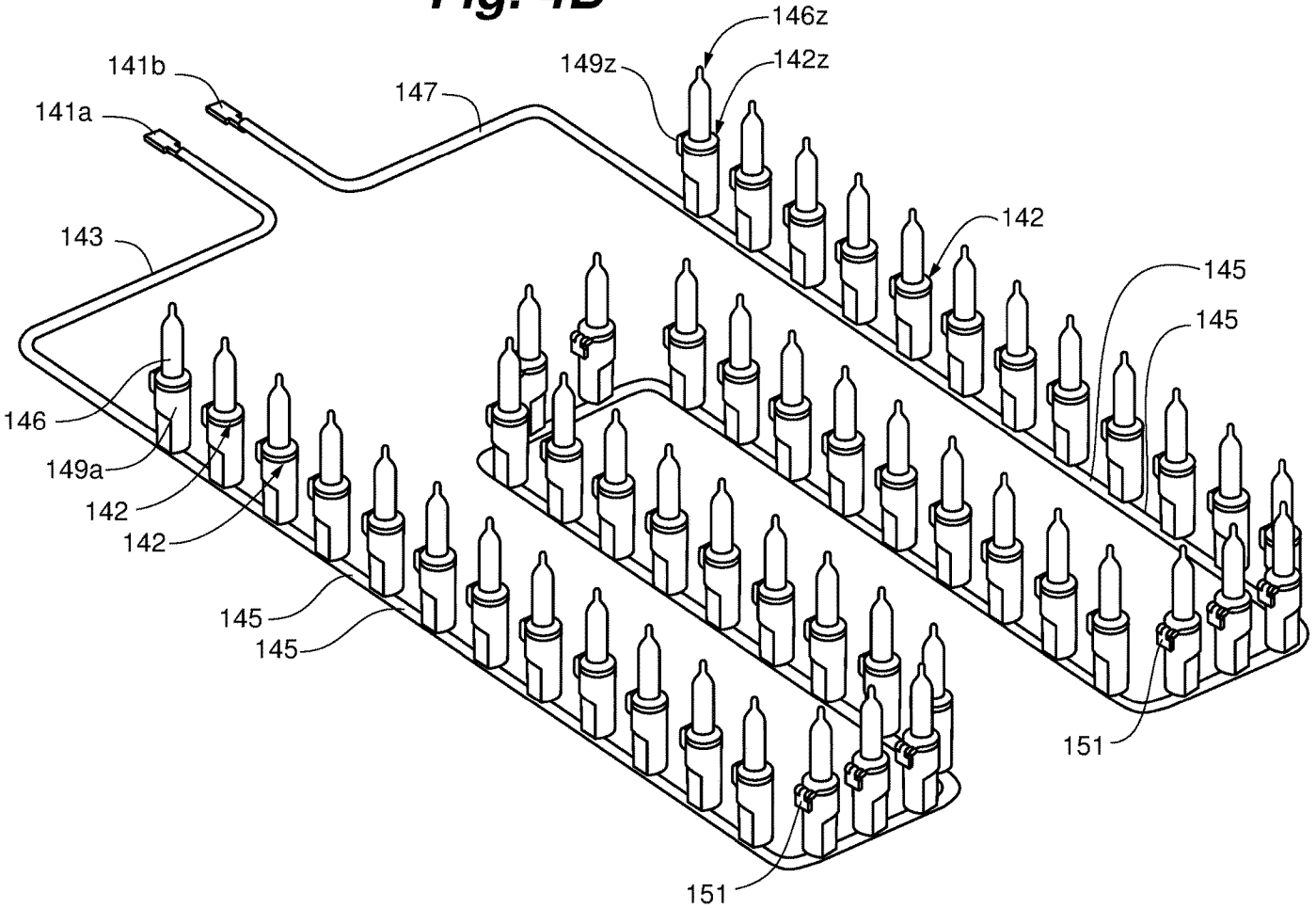
FIG. 4B depicts a wiring layout with wires and lamps of the light string of FIG. 4A.
Figure 4C:
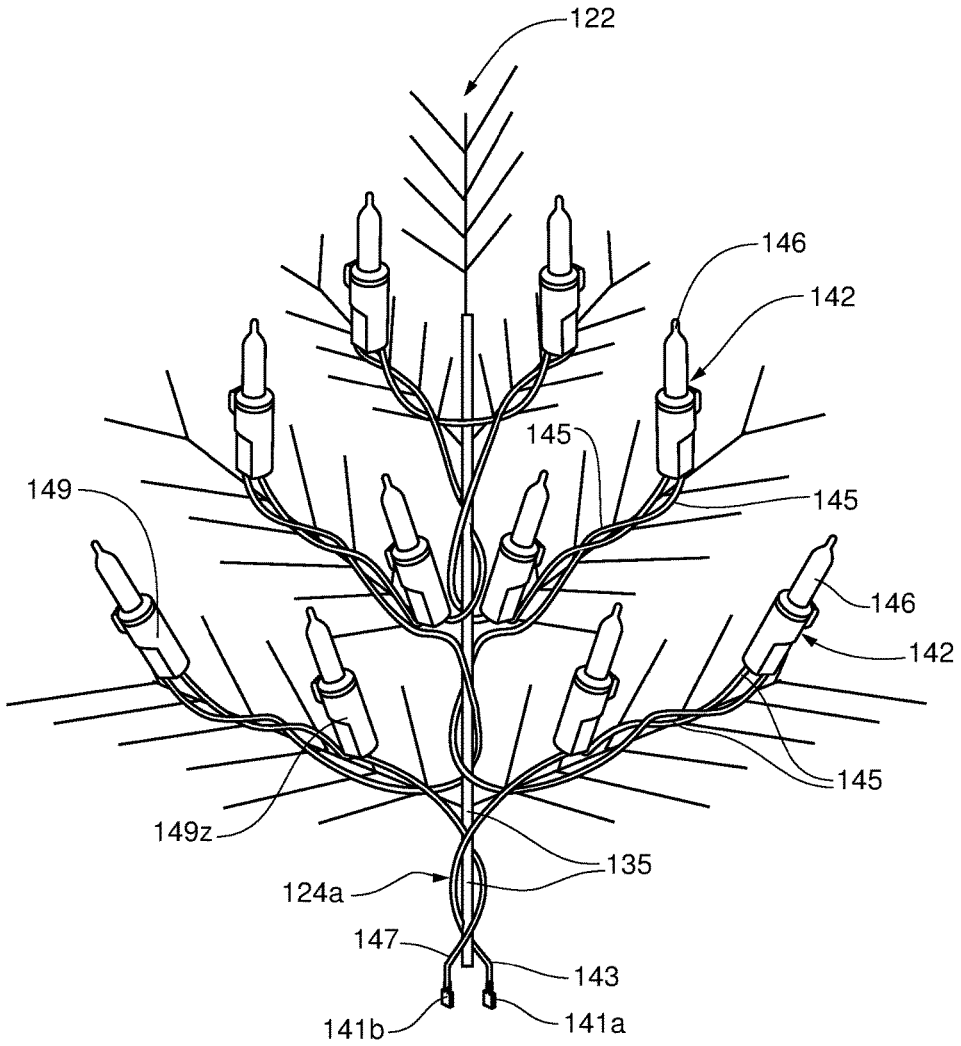
FIG. 4C depicts the light string of FIGS. 4A and 4B attached to a tree branch.

Referring also to FIGS. 4B and 4C, a "single-wire" light string 124*a* further illustrating the construction details and application to a tree is depicted. Light string 124*a* of FIG. 4B as depicted is substantially the same as light string 124*a* as depicted and described with respect to FIG. 4A.

In an embodiment, and as described in part above, light string 124*a* includes first or lead wire 143 with terminal 141*a*, a plurality of lighting assemblies 142, a plurality of intermediate wires 145, last or return wire 147 with terminal 141*b*.

Each lighting assembly 142 includes lighting element 146 and lamp holder 149. Each lamp holder 151 may include lamp lock 151 which locks an adapter or base connected to lighting element 146 to lamp holder 151 so as to prevent lighting element 146 from being accidentally removed from lamp holder 151. Lamp lock device 151 may also serve to orient lighting element 146 to lamp holder 149, such that the electrical polarity of lighting element 146 matches the electrical polarity of lamp holder 149.

Each intermediate wire at a first end is inserted into a lamp holder 149 to make an electrical connection to an electrical lead of a lighting element 146, and at a second end is inserted into a another lamp holder 149 to make an electrical connection with another lighting element 146, as part of the series connection. As depicted, neither first/lead wire 143 nor last/return wire 147 are twisted about intermediate wires 145. In an embodiment, and as depicted, single-wire light string 124*a* also does not include any other supporting strands woven about intermediate wires 145.

In another embodiment, neither first wire 143 nor last wire 147 are twisted about all of the intermediate wires, but one of wire 143 or 147 may be twisted about some of the intermediate wires, which in an embodiment, means less than half of the intermediate wires 145.

Terminals 141*a* and 141*b* may be connected to terminals of wiring harness 204 so as to be electrically connected to a power source.

In an alternate embodiment, lead wires 143 and 147 are integrated into wiring harness subassembly 204. In such an embodiment, terminals of harness 204 may comprise terminals of the type depicted as 141*a* and 141*b*. Terminals 141*a* and 141*b* may be terminals adapted to be received by a lamp holder 149. In such an embodiment, an electrical connection between an external portion of wiring harness 204 connects to light string 124*a* at a standard lamp holder 149, thereby avoiding the use of other types of connectors, including connectors at a trunk wall.

In an alternate embodiment, wiring harness first and second power wires 152 and 154 comprise the lead and return wires, and the lamp holders 156 and 158 depicted in FIG. 1 comprise the first and last lamp holders of light string 124, namely 149*a* and 149*z*.

In such an embodiment, portions of light string 124*a* are integrated into wiring harness 204. As such, first wire 143 and last wire 147 of light string 124 are attached to an external portion of light string 124*a*, extend through opening 136 in trunk body 121, and integrate and attach to wiring harness 204. In an embodiment, first and last wires 143 extend axially inside trunk body 121 to one of electrical connector 222 or 230.

As such, light strings 124*a* are integrated into a wiring harness substantially inside a trunk of a tree 100, making electrical connection to electrical connectors located at ends of their respective tree portions, and to power cord 216.

First/lead wire 143 and last/return wire 147 extend or enter trunk body 121 (or 161 and so on) through a common opening in the trunk. In other embodiments, wires 143 and 147 may not enter the trunk body at a common opening, but rather, wire 143 may enter at one opening, and wire 147 may enter at another opening. In one such embodiment, lead wire 143 may enter/exit trunk 121 at a first opening 136 at a first tree height, and return wire 147 may enter/exit trunk 121 at a second opening 136 at a second tree height. The first and second tree heights may not be the same.

In the depicted embodiment, first wire 143 and last wire 147 both make electrical connection to a common electrical connector 222 or 230. In alternate embodiments, first wire 143 may connect to an electrical connector 222, while last wire 147 connects to a different electrical connector, connector 230 at the opposite end of the trunk body. In one such embodiment, first wire 143 and last wire 147 do not connect to a common electrical connector, and do not enter/exit the trunk body through a common opening in the trunk body.

In an alternate embodiment, light string 124 comprises a traditional twisted pair light string 124. Unlike the embodiment depicted in FIG. 4A-B, which comprises a "single-wire" light string since only a single wire connects each pair of lamp holders, with no additional wire twisted about the intermediate wire 145, known twisted-pair light strings have a wiring configuration in which either the lead wire or the return wire is spans nearly the entire length of the light string, and is intertwined, or wrapped about, many of the intermediate wires 145. By twisting a lead or return wire about the intermediate wires, it is less likely that an intermediate wire will be accidentally pulled from one of its lamp holders, and less likely that an intermediate wire will be stretched and broken. While the single-wire design as depicted may lack such extra pull strength, other advantages are realized due to the use of less overall wire, including decreased costs and increased aesthetic appearance.

In another embodiment, light string 124 comprises a series-parallel (or parallel-series) light string similar to ones depicted and described in US Patent Publication No. US 2012/0075863, having application Ser. No. 13/112,749, and entitled DECORATIVE LIGHT STRING FOR ARTIFICIAL LIGHTED TREE, which is herein incorporated by reference in its entirety.

Referring specifically to FIG. 4C, light string 124*a* of the claimed invention is depicted as attached to a branch 122 and branch extension 130. Unlike a twisted pair light string 124 in which a return wire would be twisted with, and follow the intermediate wires 145 throughout the branch and branch extension, return wire 147 is twisted about a portion of branch frame 135 and terminates at last lamp holder 149*z*. Unlike a traditional twisted pair light string 124, intermediate wires 145 may be twisted about one another as shown (recalling that a traditional twisted pair light string twists intermediate wires with either a lead wire or a return wire). In other embodiments, intermediate wires 145 may not be twisted about one another. The resulting effect of not having a return wire 147 twisted about all intermediate wires 145 is that less overall wire may be used since a return wire of light string 124*a* will be shorter than a return wire that twists about all intermediate wires. Not only does this save in manufacturing costs, but also improves the aesthetic appearance of tree 100.

Figures 6, 7, 8, 9:
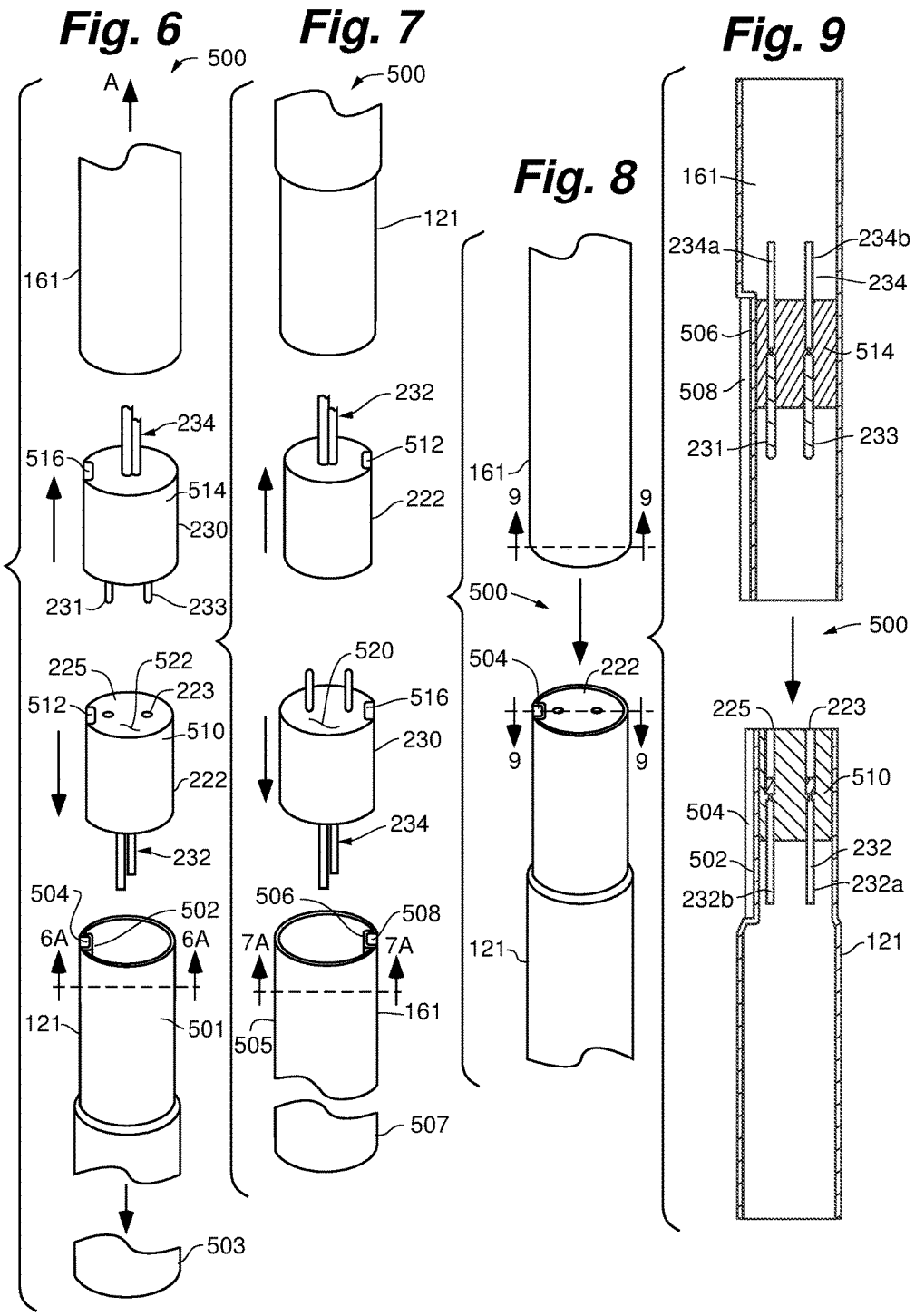
FIG. 6 depicts a pair of trunk bodies and a pair of electrical connectors, according to an embodiment of the claimed invention.
FIG. 7 depicts the pair of trunk bodies and pair of electrical connectors of FIG. 6 in an inverted view.
FIG. 8 depicts the electrical connectors of FIGS. 6 and 7 assembled into their respective trunk bodies.
FIG. 9 is a cross sectional view of the trunk bodies and electrical connectors of FIG. 8.
Figures 61, 62, 63, 64:
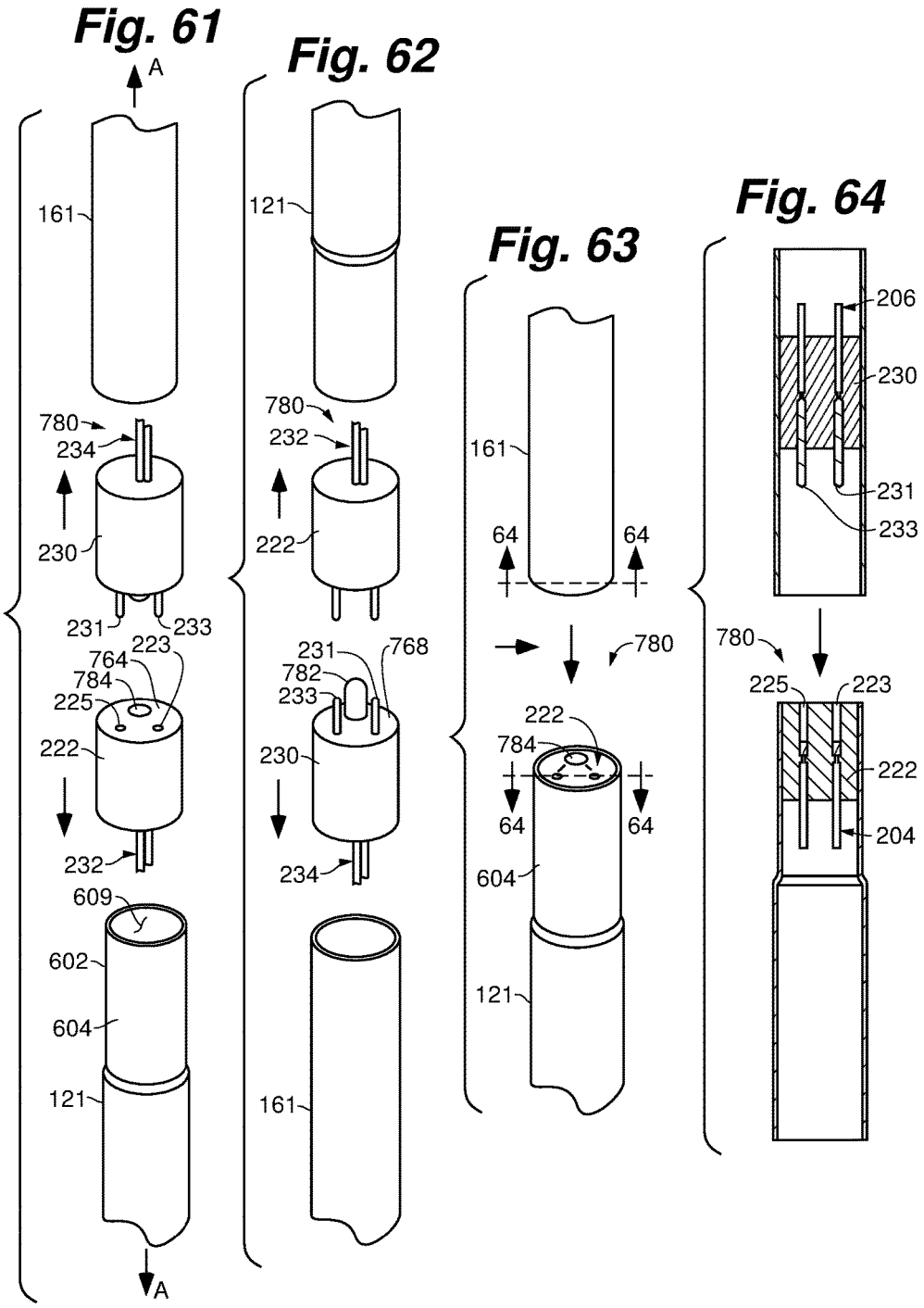
FIG. 61 depicts a pair of non-keyed trunk bodies and a pair of keyed electrical connectors, according to another embodiment of the claimed invention.
FIG. 62 depicts the pair of trunk bodies and pair of electrical connectors of FIG. 61 in an inverted view.
FIG. 63 depicts the electrical connectors of FIGS. 61 and 62 assembled into their respective trunk bodies.
FIG. 64 is a cross sectional view of the trunk bodies and electrical connectors of FIG. 63.

Referring generally to FIGS. 6-64, multiple embodiments of trunk bodies and electrical connectors are depicted. In some embodiments, pairs of trunk bodies couple in a manner that prevents or minimizes rotation of one trunk body to another about an Axis A, resulting in prevention or minimization of rotation of one tree portion relative to another. In some embodiments, the electrical connectors are fit into the trunk body portions such that the electrical connectors cannot rotate relative to one another, or relative to the trunk body that houses it. In some embodiments, both the trunk bodies lock and the electrical connectors lock.

The "locking" of one trunk body to another, or one electrical connector to another, may generally be referred to "one-way keying" or "two-way keying". In other words, the trunk body ends, and/or the electrical connectors are keyed to one another, and fit in only one orientation or two possible rotational orientations or alignments.

Referring specifically to FIGS. 6-9, an embodiment of a keyed tree trunk system 500 is depicted. In this embodiment, both the trunk bodies 161/121 and the electrical connectors 222/230 are one-way keyed.

Known decorative trees generally comprise trunk sections that are perfectly circular in cross section such that the trunk sections do not need to be rotationally aligned relative to one another when fitting them together. Alternatively, known decorative tree designs may use an intermediate coupler to received and join trunk sections, such as the tree design of US 2010/0072747 to Krize, "Tree Pole Coupler System". The use of intermediate couplers may result in decreased strength at the joint formed at the connection of the tree sections. In contrast, embodiments of the invention include trunk bodies that may not comprise circular ends, nor rely on intermediate couplers to accomplish keying of tree sections and the forming of strong tree section joints.

In an embodiment, hollow trunk body 121 includes first end 501, second end 503, elongated projection or rib 502 that axially extends towards a center of trunk body 121, and extends vertically and downwardly along an inside wall of trunk body 121. Rib 502 defines channel 504. As will be described further below, rib 502 forms a key that fits into a keyway 512 of connector 222, and channel 504 forms a keyway for a key of trunk body 161. In an embodiment, first end 501 may have an outer diameter that is smaller than second end 503, as depicted.

Figure 6A:
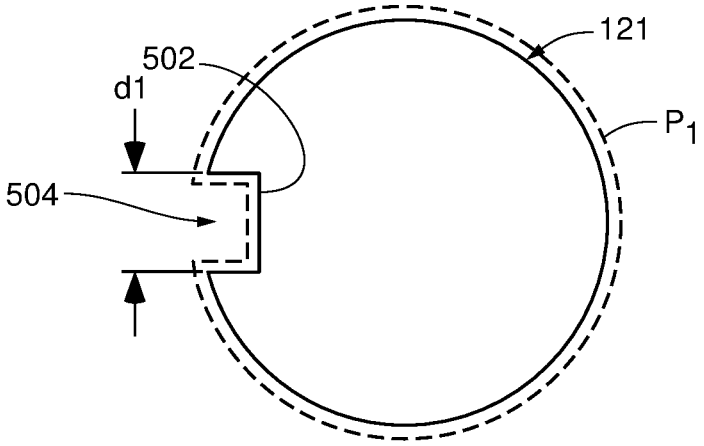
FIG. 6A is a cross-sectional view of a trunk body of FIG. 6.
Figures 37, 38, 38A, 39, 40:
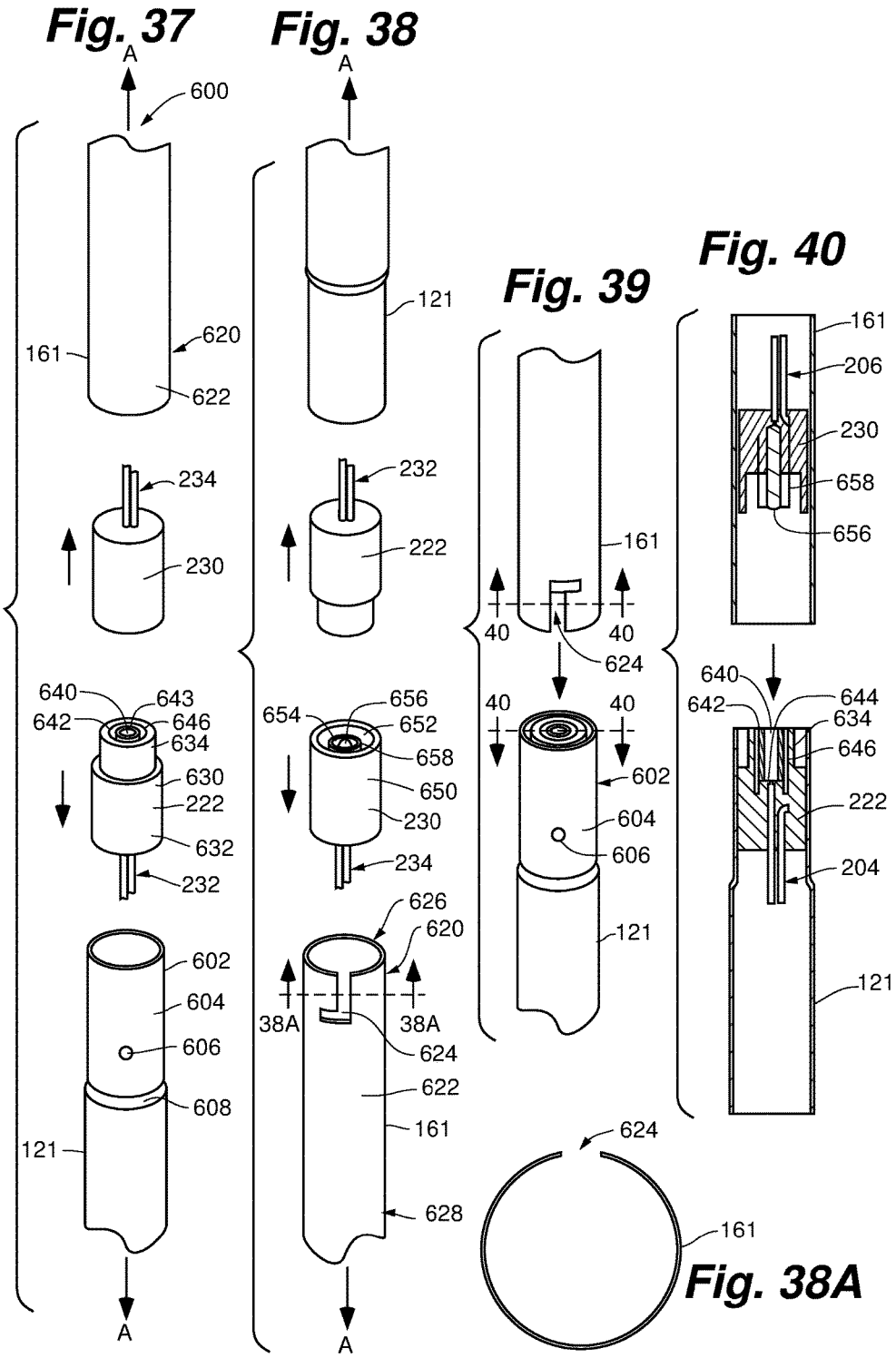
FIG. 37 depicts a pair of trunk bodies and a pair of electrical connectors, according to another embodiment of the claimed invention.
FIG. 38 depicts the pair of trunk bodies and pair of electrical connectors of FIG. 37 in an inverted view.
FIG. 38A is a cross-sectional view of a trunk body of FIG. 38.
FIG. 39 depicts the electrical connectors of FIGS. 37 and 38 assembled into their respective trunk bodies.
FIG. 40 is a cross sectional view of the trunk bodies and electrical connectors of FIG. 39.
Figures 41, 42, 43, 44:
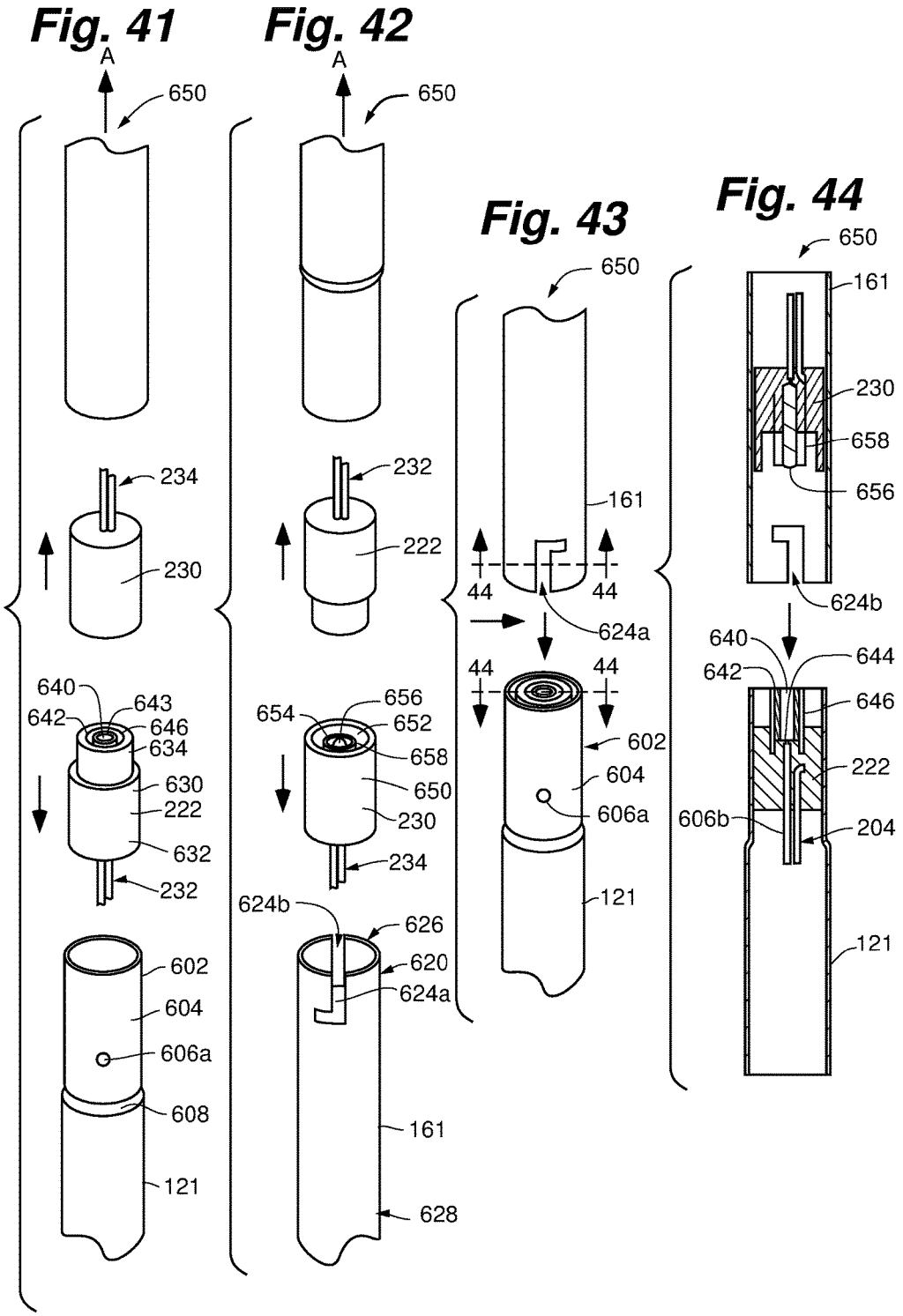
FIG. 41 depicts a pair of trunk bodies and a pair of electrical connectors, according to another embodiment of the claimed invention.
FIG. 42 depicts the pair of trunk bodies and pair of electrical connectors of FIG. 41 in an inverted view.
FIG. 43 depicts the electrical connectors of FIGS. 41 and 42 assembled into their respective trunk bodies.
FIG. 44 is a cross sectional view of the trunk bodies and electrical connectors of FIG. 43.
Figures 45, 46, 47, 48:
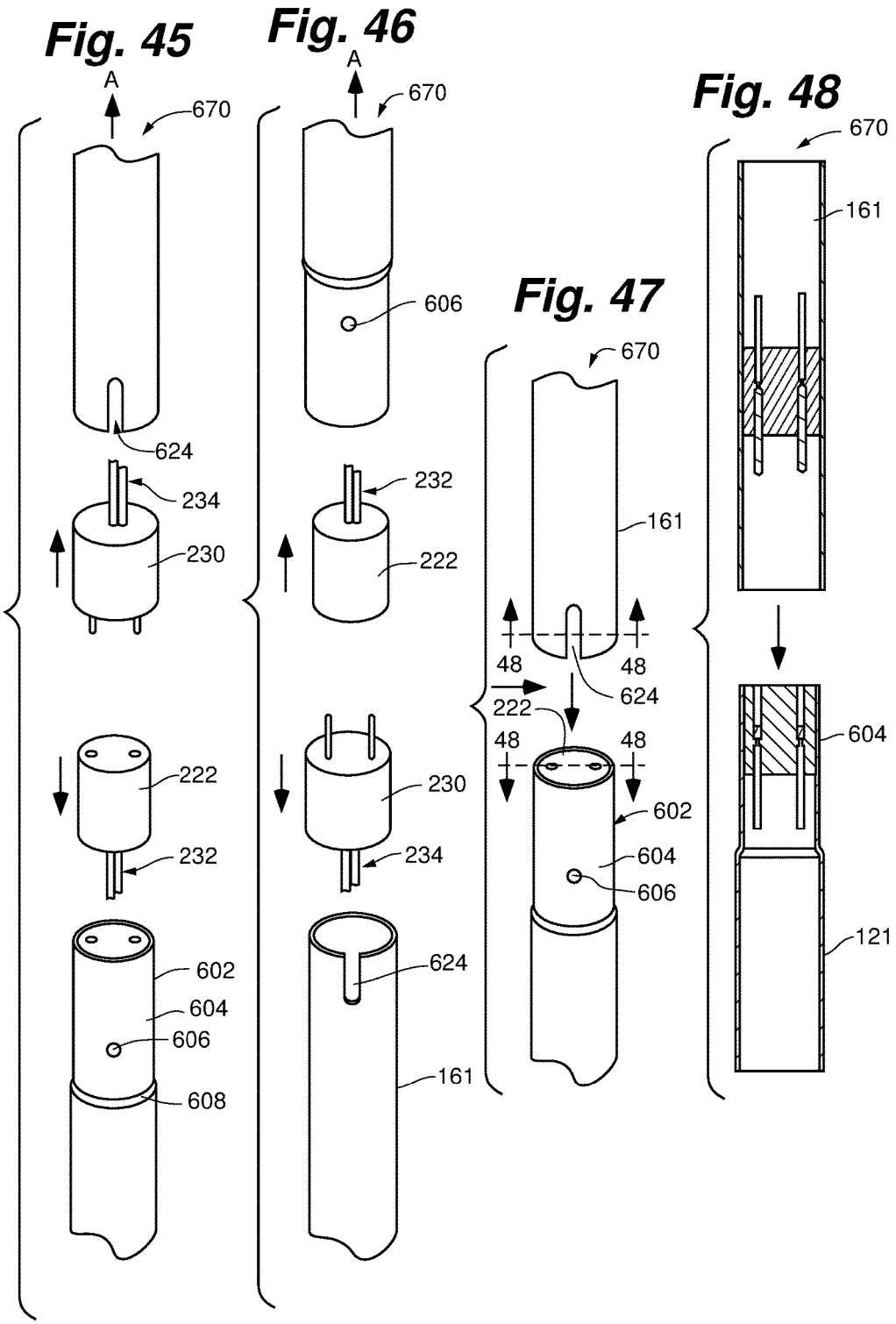
FIG. 45 depicts a pair of trunk bodies and a pair of electrical connectors, according to another embodiment of the claimed invention.
FIG. 46 depicts the pair of trunk bodies and pair of electrical connectors of FIG. 45 in an inverted view.
FIG. 47 depicts the electrical connectors of FIGS. 45 and 46 assembled into their respective trunk bodies.
FIG. 48 is a cross sectional view of the trunk bodies and electrical connectors of FIG. 47.
Figures 49, 50, 51, 52:
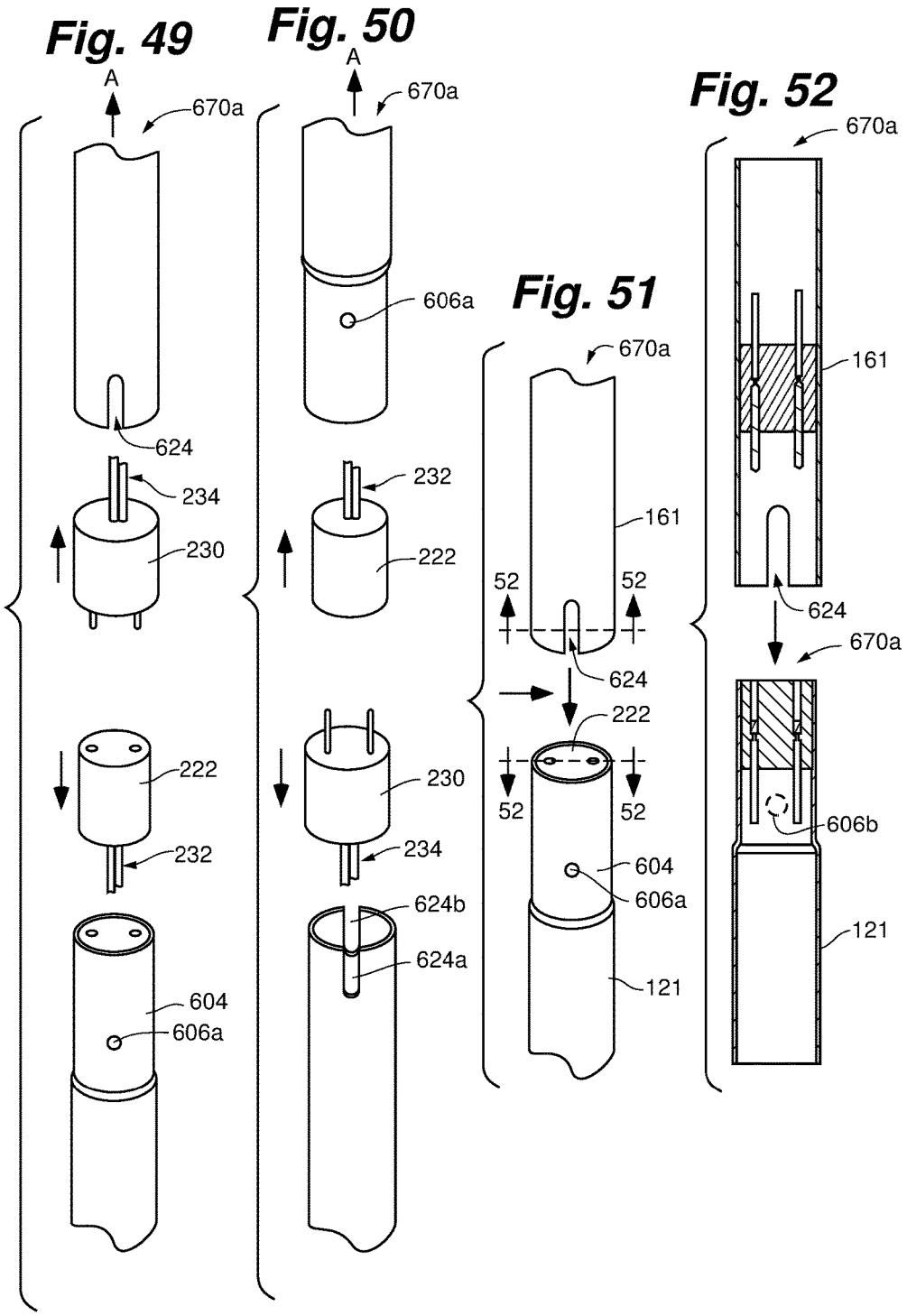
FIG. 49 depicts a pair of trunk bodies and a pair of electrical connectors, according to another embodiment of the claimed invention.
FIG. 50 depicts the pair of trunk bodies and pair of electrical connectors of FIG. 49 in an inverted view.
FIG. 51 depicts the electrical connectors of FIGS. 49 and 50 assembled into their respective trunk bodies.
FIG. 52 is a cross sectional view of the trunk bodies and electrical connectors of FIG. 51.
Figures 53, 54, 55, 56:
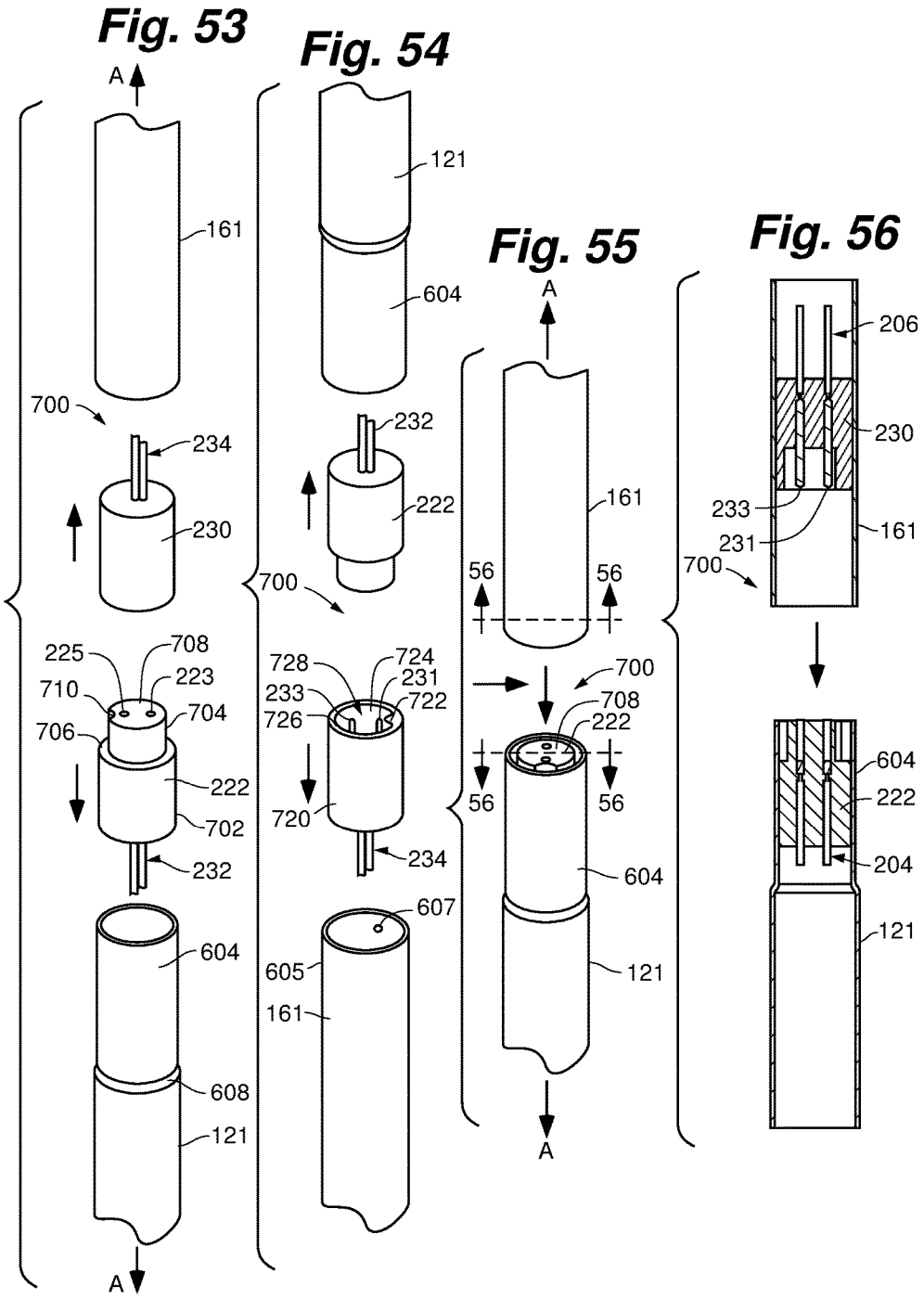
FIG. 53 depicts a pair of non-keyed trunk bodies and a pair of keyed electrical connectors, according to another embodiment of the claimed invention.
FIG. 54 depicts the pair of trunk bodies and pair of electrical connectors of FIG. 53 in an inverted view.
FIG. 55 depicts the electrical connectors of FIGS. 53 and 54 assembled into their respective trunk bodies.
FIG. 56 is a cross sectional view of the trunk bodies and electrical connectors of FIG. 55.

Referring specifically to FIG. 6A, first end 501 of hollow trunk body 121 is depicted in cross-section, and defines an outer perimeter shape P1. Perimeter shape P1 as depicted is not circular about its entire circumference, but rather, defines an inwardly projecting portion that defines rib 502. In the embodiment depicted, perimeter shape P1 is contiguous (as contrasted to a non-contiguous perimeter shape of the trunk body 161 as depicted in FIGS. 38 and 38A and described below). Keyway 504 defines a diameter d1.

As depicted in FIGS. 6-9, hollow trunk body 161 similarly includes rib or key 506 and defines channel or keyway 508. In an embodiment, key 306 of trunk body 161 is sized to be received by channel or keyway 504. In an embodiment, hollow trunk body 161 includes first end 505 and second end 507. In an embodiment, and as depicted, first end 505 has an outer diameter that is substantially the same as an outer diameter of second end 507.

Figure 7A:
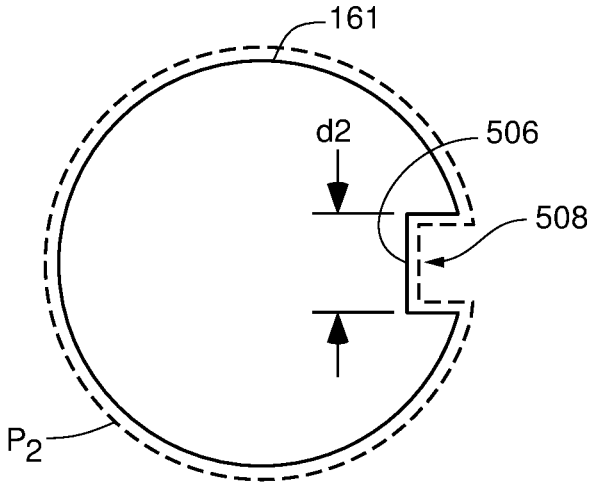
FIG. 7A is a cross-sectional view of a trunk body of FIG. 7.
Figures 10, 11, 12, 13:
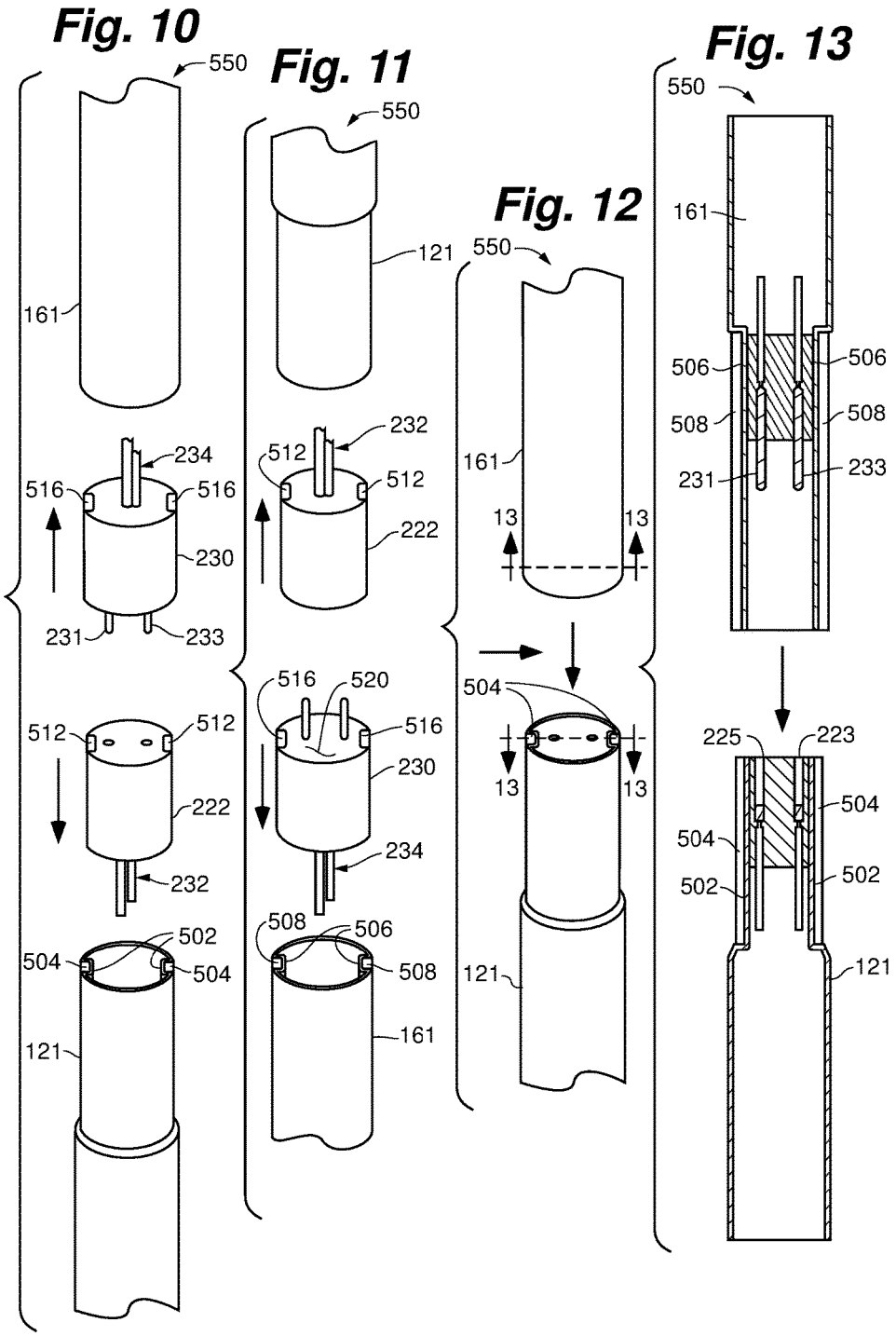
FIG. 10 depicts a pair of trunk bodies and a pair of electrical connectors, according to another embodiment of the claimed invention.
FIG. 11 depicts the pair of trunk bodies and pair of electrical connectors of FIG. 10 in an inverted view.
FIG. 12 depicts the electrical connectors of FIGS. 10 and 11 assembled into their respective trunk bodies.
FIG. 13 is a cross sectional view of the trunk bodies and electrical connectors of FIG. 12.
Figures 14, 15, 16, 17:
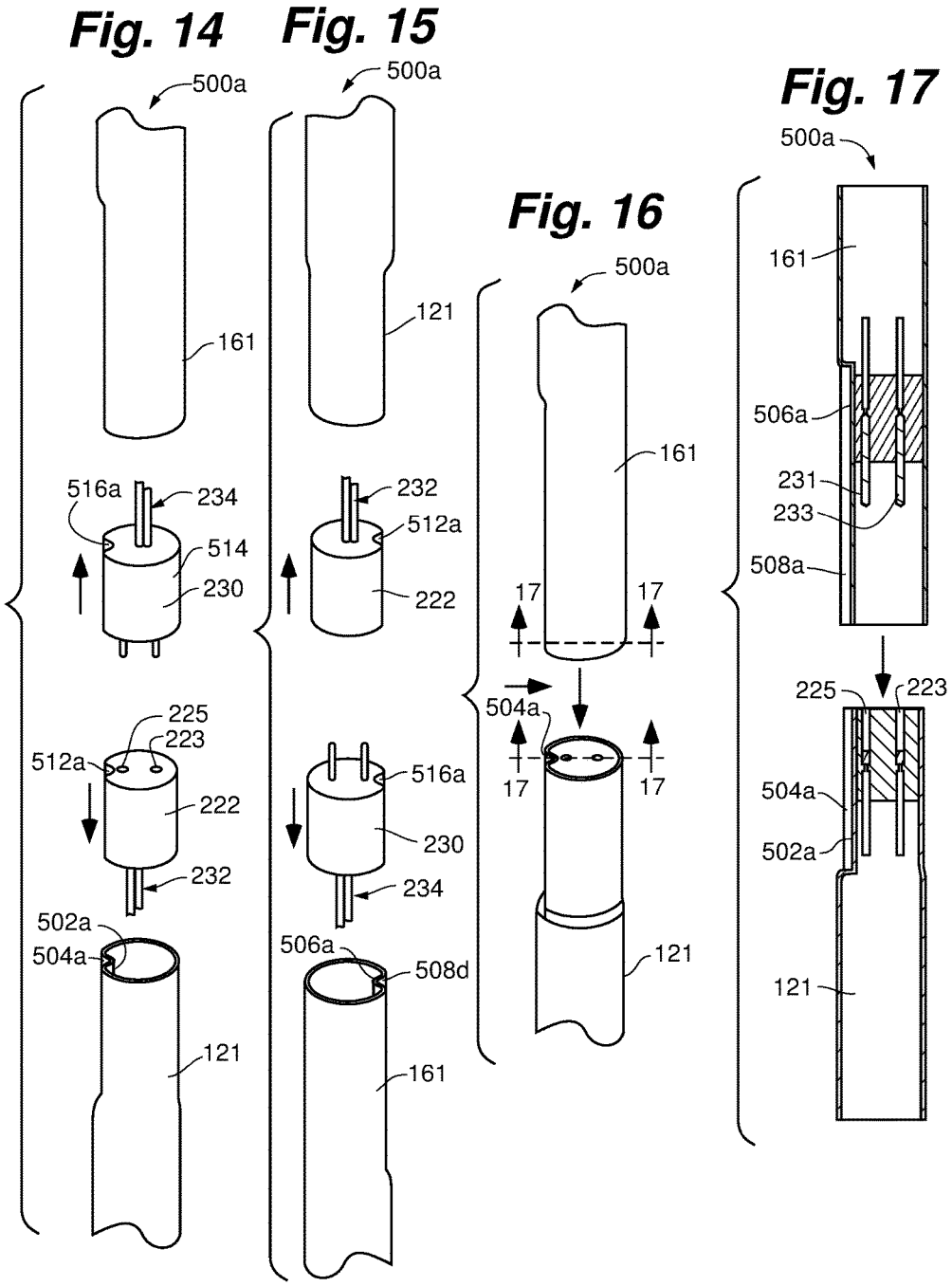
FIG. 14 depicts a pair of trunk bodies and a pair of electrical connectors, according to another embodiment of the claimed invention.
FIG. 15 depicts the pair of trunk bodies and pair of electrical connectors of FIG. 14 in an inverted view.
FIG. 16 depicts the electrical connectors of FIGS. 14 and 15 assembled into their respective trunk bodies.
FIG. 17 is a cross sectional view of the trunk bodies and electrical connectors of FIG. 16.
Figures 18, 19, 20, 21:
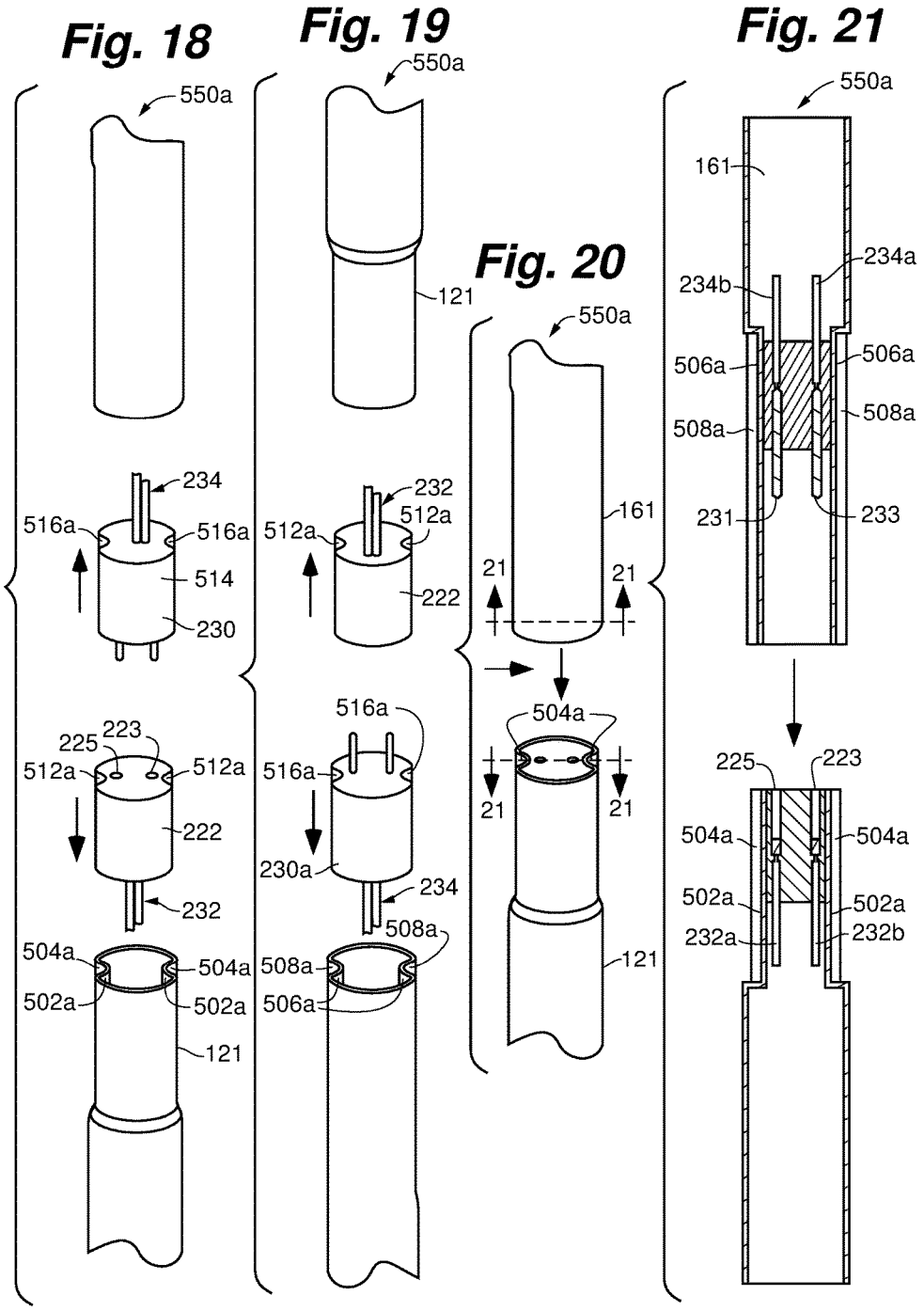
FIG. 18 depicts a pair of trunk bodies and a pair of electrical connectors, according to another embodiment of the claimed invention.
FIG. 19 depicts the pair of trunk bodies and pair of electrical connectors of FIG. 18 in an inverted view.
FIG. 20 depicts the electrical connectors of FIGS. 18 and 19 assembled into their respective trunk bodies.
FIG. 21 is a cross sectional view of the trunk bodies and electrical connectors of FIG. 20.
Figures 22A, 22B, 23, 24:
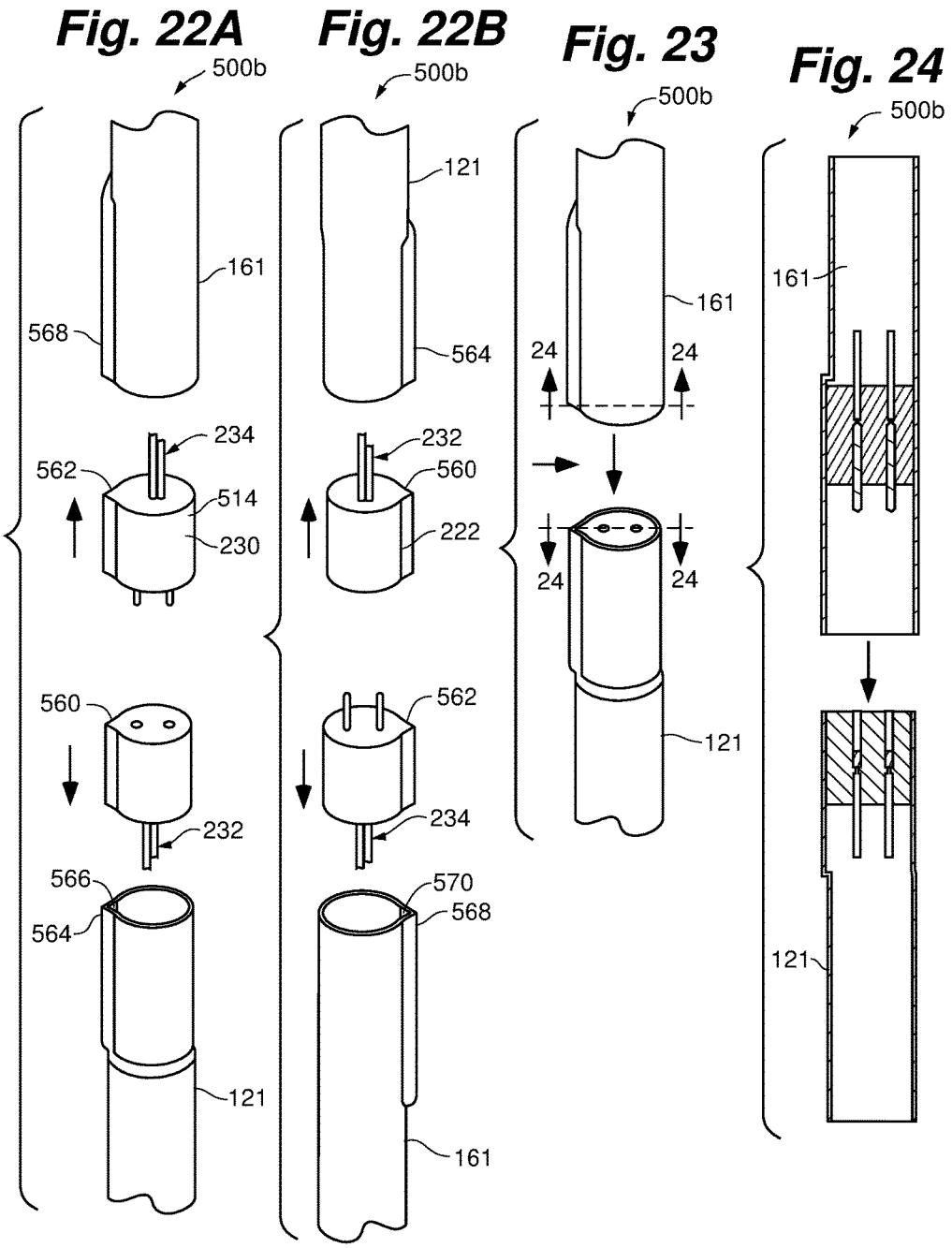
FIG. 22A depicts a pair of trunk bodies and a pair of electrical connectors, according to another embodiment of the claimed invention.
FIG. 22B depicts the pair of trunk bodies and pair of electrical connectors of FIG. 22A in an inverted view.
FIG. 23 depicts the electrical connectors of FIGS. 22A and 22B assembled into their respective trunk bodies.
FIG. 24 is a cross sectional view of the trunk bodies and electrical connectors of FIG. 23.
Figures 25, 26, 27, 28:
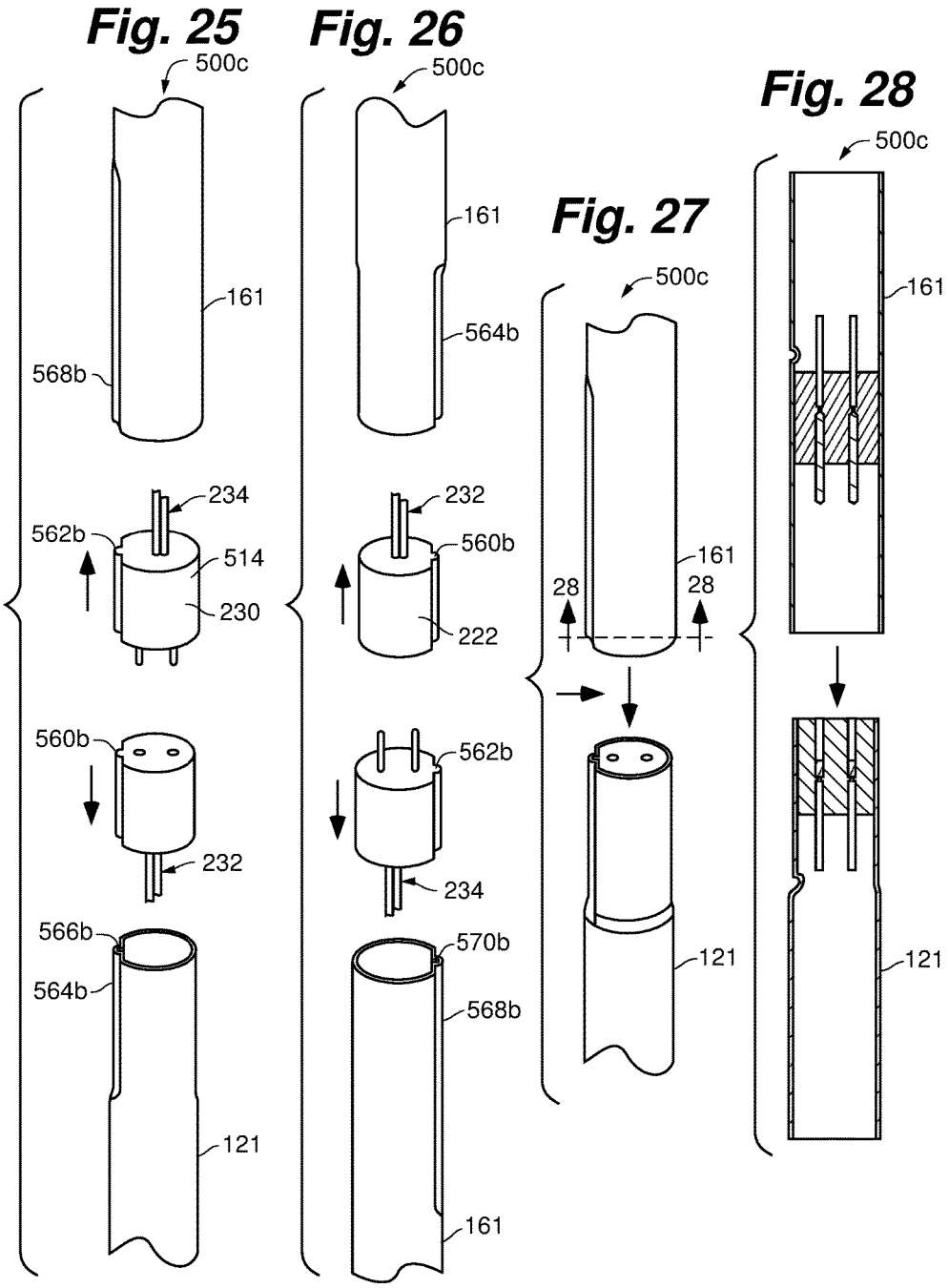
FIG. 25 depicts a pair of trunk bodies and a pair of electrical connectors, according to another embodiment of the claimed invention.
FIG. 26 depicts the pair of trunk bodies and pair of electrical connectors of FIG. 25 in an inverted view.
FIG. 27 depicts the electrical connectors of FIGS. 25 and 26 assembled into their respective trunk bodies.
FIG. 28 is a cross sectional view of the trunk bodies and electrical connectors of FIG. 27.
Figures 29, 30, 31, 32:
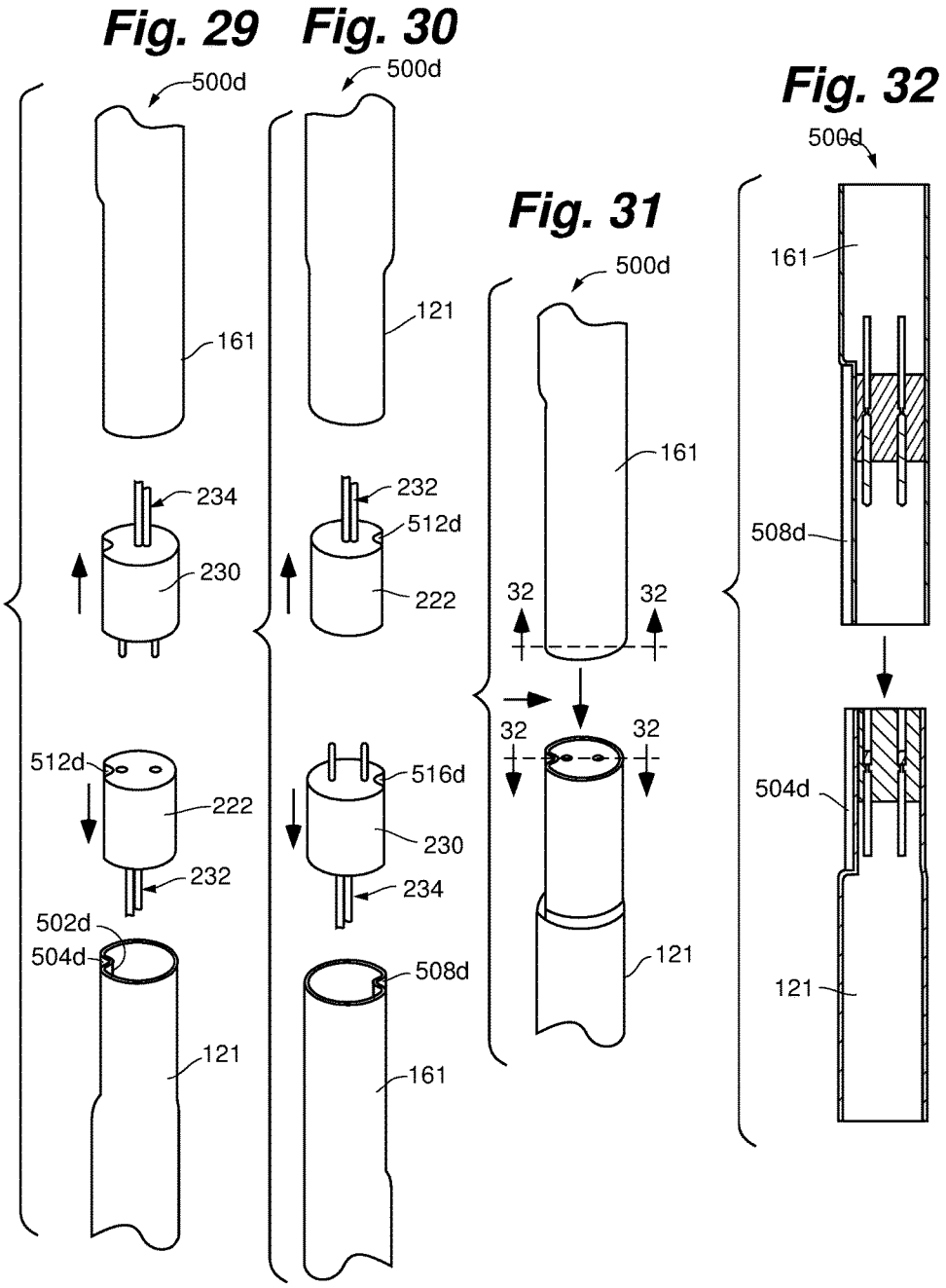
FIG. 29 depicts a pair of trunk bodies and a pair of electrical connectors, according to another embodiment of the claimed invention.
FIG. 30 depicts the pair of trunk bodies and pair of electrical connectors of FIG. 29 in an inverted view.
FIG. 31 depicts the electrical connectors of FIGS. 29 and 30 assembled into their respective trunk bodies.
FIG. 32 is a cross sectional view of the trunk bodies and electrical connectors of FIG. 31.
Figure 33:
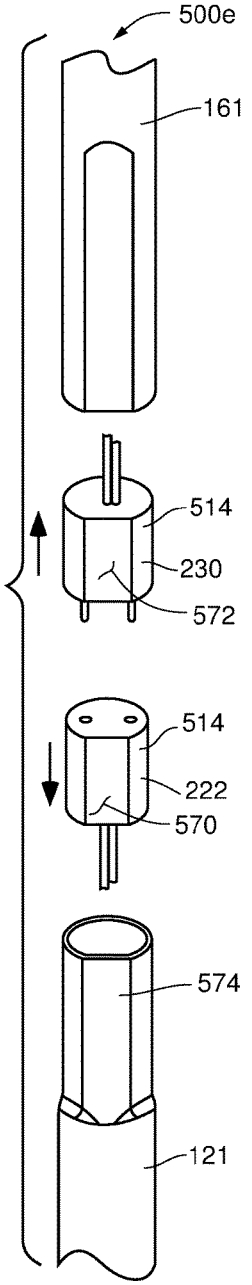
FIG. 33 depicts a pair of trunk bodies and a pair of electrical connectors, according to another embodiment of the claimed invention.
Figure 34:
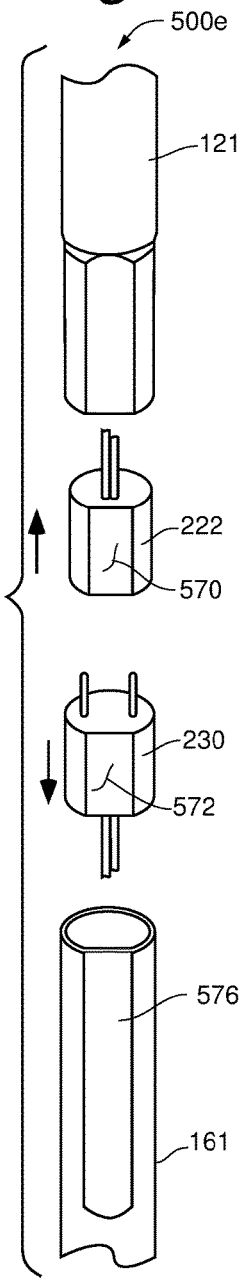
FIG. 34 depicts the pair of trunk bodies and pair of electrical connectors of FIG. 33 in an inverted view.
Figure 35:
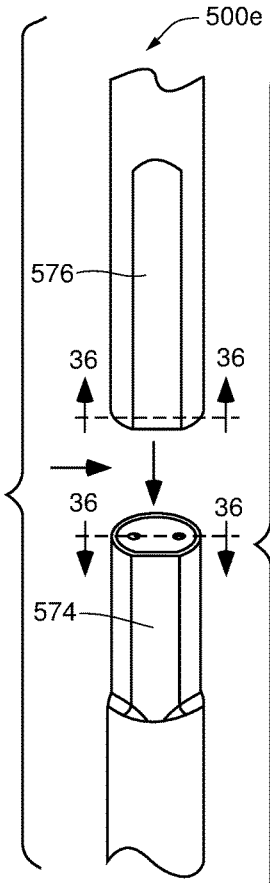
FIG. 35 depicts the electrical connectors of FIGS. 33 and 34 assembled into their respective trunk bodies.
Figure 36:
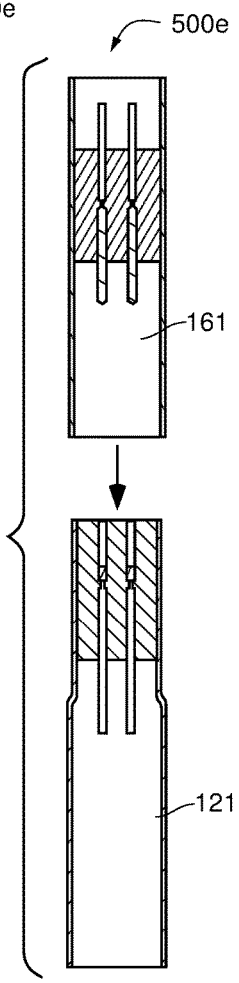
FIG. 36 is a cross sectional view of the trunk bodies and electrical connectors of FIG. 35.

Referring specifically to FIG. 7A, first end 505 of hollow trunk body 161 is depicted in cross-section, and defines an outer perimeter shape P2. Perimeter shape P2 as depicted is not entirely circular about its entire circumference, but rather, defines an inwardly projecting portion that defines rib 506. In the embodiment depicted, perimeter shape P2 is contiguous (as contrasted to a non-contiguous perimeter shape of the trunk body 161 as depicted in FIGS. 38 and 38A and described below). Key 506 defines a diameter d2. In an embodiment diameter d2 is slightly less than diameter d1 such that key 506 is insertable into keyway 504. In an embodiment perimeter shape P2 is similar, and complementary to perimeter shape P1, Electrical connector 222 in an embodiment comprises body portion 510 defining keyway or channel 512; electrical connector 230 includes body portion 514 defining channel or keyway 516. In an embodiment, body portions 510 and 514 may comprise a non-conducting material such as a plastic material, including polyethylene, polypropylene, and so on.

During manufacturing assembly, connector 230 confronts trunk body 161 such that keyway 516 is aligned to rib/key 506. Connector 230 is inserted into a hollow end portion of trunk body 161 such that rib 506 slides along channel 516, while keyway 516 receives all or a portion of rib 506. In an embodiment, connector 530 is inserted entirely within trunk body 161, and in the embodiment depicted, top surface 520 of body portion 514 is located a distance from an end opening of trunk body 161. When assembled, in an embodiment, electrical connector 222 cannot rotate within trunk body 161.

As compared to known methods of securing an electrical connector to the inside of a trunk, the arrangement of the invention provides a more secure and robust solution. Known methods typically employ one or several fasteners, such as screws, that are aligned perpendicular to Axis A, and driven through a wall of the trunk and into the connector. Having one, two, or three screws at one to three single points of connection does not rotationally secure a connector to a trunk as securely as the rib and slot arrangement described above, which entails the connector being secured along its entire length.

Connector 230 can only be aligned with, and fit into, trunk body 161 in one rotational orientation or one alignment in order to fit into trunk body 161. As such, electrical connector 230 is keyed to trunk body 161, and keyed in a one-way manner.

During manufacturing assembly, connector 222 confronts trunk body 121 such that keyway 512 is aligned to rib/key 502 (see FIGS. 6 and 7). Connector 222 is inserted into a hollow end portion of trunk body 121 such that rib 502 slides along keyway 512, while keyway 512 receives all or a portion of rib/key 502. In an embodiment, connector 222 is inserted entirely within trunk body 121, and in the embodiment depicted, top surface 522 of body portion 510 is located flush with, or adjacent to, an end opening of trunk body 121. When connected, electrical connector 222 cannot rotate within trunk body 121.

Connector 222 can only be aligned with, and fit into, trunk body 121 in one rotational orientation or one alignment in order to fit into trunk body 121. As such, electrical connector 222 is keyed to trunk body 121, and keyed in a one-way manner.

Referring to FIGS. 8 and 9, when a user assembles tree 100 by joining tree portion 102 to tree portion 104, trunk body 161 with connector 230 receives an end of trunk body 121 with connector 222. Rib or key 506 of trunk body 161 fits into channel or keyway 504, allowing the end of trunk body 121 to be slid into trunk body 161. As such, trunk body 121 is keyed to trunk body 161. As described and depicted, the keying is a one-way keying such that the two trunk bodies fit together in only one rotational orientation/alignment. In an alternative embodiment, multiple keys and key ways could be used such that two-way keying, three-way keying, and so on, is possible (see FIGS. 10-13 for two-way keying embodiments).

Although "ribs" and "channels" are described for the key and keyway of system 500, it will be understood that other structural features may comprise keys and keyways of the claimed invention.

Further, it will be understood that while in an embodiment trunk keyway 504 of trunk body 121 is only just large enough to receive trunk key 506 of trunk body 161, such that substantially no rotational movement or twisting between trunk bodies 121 and 161 is possible, in other embodiments, keyway 504 may be somewhat larger than key 506 such that trunk bodies 121 and 161 may more easily be aligned with one another, resulting in some rotational movement upon coupling of the trunk bodies, and hence the tree portions.

At the same time, electrical terminal 233 is received by electrical terminal 223, electrical terminal 231 is received by electrical terminal 225, such that an electrical connection is made between terminals 223 and 233 and between electrical terminals 225 and 231. As such, an electrical connection is made between the two tree portions and their respective wiring harnesses/subassemblies, including between wire sets 232 and 234, and between wires 232*a* and 234*a* and between 232*b* and 234*b*.

Further, while the above embodiment is described with respect to two particular tree portions 104 and 106, it will be understood that the connection system 500 described above applies equally to other tree portion connections or couplings.

Tree 100 with its trunk-keyed system and connector keyed system provide a number of advantages, some of which have been discussed above. One advantage is that individual tree portions will not rotate relative to one another. In addition to the general aesthetic advantages of non-rotation of a decorated or lighted tree, the one-way keying feature permits the use of single-wire light string as it reduces the risk of loosening or pulling wires from the light string during rotation of tree portions. Another advantage is that the electrical terminals of the respective tree portions will be properly aligned when the respective trunk bodies are aligned, thusly avoiding bent terminals and/or poor electrical connections between tree portions.

In embodiments of tree 100 that include the trunk-keyed system, but with traditional external light strings and without keyed electrical connectors, the trunk-keying prevents relative rotation of the tree portions, which also prevents twisting and damage to light strings that may be attached to branches of a first tree portion and also attached to branches of a second tree portion.

Referring to FIGS. 10-13, a two-way keying system 550 is depicted. System 550 is substantially similar to system 500, except that connectors 222 and 230, and trunk bodies 121 and 161 each include two keys and two keyways.

This two-way keying of both the trunk bodies and the connectors provides the additional advantage that trunk bodies 121 and 161, as well as electrical connectors 222 and 230 can be coupled one of two possible alignments, each alignment or position being 180 degrees opposite.

When assembled, trunk-body keys 502 are received by their respective electrical connector keyways 512; trunk body keys 506 are received by their respective electrical keyways 516; and trunk keys 506 are received by their respective trunk keyways 504, thusly rotationally locking tree portions 104 and 106 via trunk two-way keying and electrical connector two-way keying.

Referring to FIGS. 14-17, another embodiment of keyed tree trunk system 500*a* is depicted. This embodiment of system 500*a* is substantially the same as the embodiment of system 500 depicted and described above with respect to FIGS. 6-9, with the primary exception of the key and keyway shapes.

As depicted, trunk keyways 504*a* and 508*a*, connector keyways 512*a* and 516*a*, trunk key 502*a* and trunk key 506*a*, each form a V shape, rather than a rectangular shape as compared to keyways 504 and 508 of FIGS. 6-9. The V shape in some instances may make it easier for a user to align trunk bodies 121 and 161 when joining tree portions 104 and 106. Further, forming a V shape keyway into trunk bodies 121 and 161 in some cases is easier to manufacture as compared to a rectangular shape.

Referring to FIGS. 18-21, a two-way keying system 550*a* is depicted. System 550*a* is substantially similar to system 550, except that the keys and keyways are V-shaped, rather than rectangular.

When assembled, trunk body keys 502*a* are received by their respective electrical connector keyways 512*a*; trunk body keys 506*a* are received by their respective electrical keyways 516*a*; and trunk keys 506*a* are received by their respective trunk keyways 504*a*, thusly rotationally locking tree portions 104 and 106 via trunk two-way keying and electrical connector two-way keying.

Referring to FIGS. 22A-24 tree trunk keying system 500*b* comprises another system featuring one-way trunk keying and one-way electrical connector keying. This embodiment of tree trunk keying system is similar to system 500*a*. However, in embodiment 500*b*, electrical connector keyways 512*a* and 516*a* are replaced by electrical connector keys 560 and 562. Keys 560 and 562 project radially outwardly and away from centers of trunk bodies 121 and 161, respectively, traversing an axial length of each connector.

Further, the keys and keyways of trunk bodies 121 and 161 are inverted such that they project radially outward and away from centers of trunk bodies 121 and 161. More specifically, trunk body 121 includes key 564 and keyway 566; trunk body 161 includes key 568 and keyway 570.

When assembled, electrical connector keys 560 and 562 are received by their respective trunk keyways 566 and 570; trunk body key 564 is received by trunk keyway 570, thusly rotationally locking tree portions 104 and 106 via trunk two-way keying and electrical connector two-way keying.

Referring to FIGS. 25-28, tree trunk keying system 500*c* is depicted. System 500*c* is substantially the same as system 500*b* depicted in FIGS. 22-14 with the exception of slightly differently shaped keys and matching keyways that include flat portions.

Referring to FIGS. 29-32, tree trunk keying system 500*d* is depicted. System 500*d* is substantially the same as system 500*a* depicted in FIGS. 14-17, with the exception that the keys and keyways are arcuate, or semi-circular in shape, rather than being V-shaped.

Referring to FIGS. 33-36, tree trunk keying system 500*e* is depicted. System 500*e* is very similar to system 500, except that the keys and keyways form planar surfaces. Electrical connectors 222 and 230 are both generally circular, but each form a flat, planar surface 570 and 572, respectively. Trunk body 121 forms a flat, planar wall 575; trunk body 576 forms a flat planar wall 576. An outer shape of connector body 514 is complementary to an inside shape of an end of trunk body 121 such that connector 222 fits into trunk body 121. When connector 222 is fit into trunk body 121, surface 570 of connector body 514 is adjacent an inside surface of wall 574 and is unable to rotate within trunk 121.

Connector 230 similarly fits into trunk body 161.

Embodiments of the tree trunk keying systems described above with respect to FIGS. 6-36 include both keyed trunk bodies and keyed electrical connectors. In the embodiments described below in FIGS. 37-44, tree trunk keying systems 600 and 650 include keyed trunk bodies, but not keyed electrical connectors.

Referring specifically to FIGS. 37-40, tree trunk keying system 600 includes trunk body 121, trunk body 161, electrical connector 222 and electrical connector 222.

In an embodiment, trunk body 121 has a generally circular, hollow narrow end 602 comprising trunk wall 604. Trunk wall 604 includes a convex projection 606 that extends radially outwardly from trunk wall 604, and a flanged portion 608.

Trunk body 161 has a generally circular end 620 comprising trunk wall 622, and defining slot 624. Slot 624 extends downwardly from a distal end 626 of end 620 towards a proximal end 628 of end 620. In an embodiment, slot 624 is L-shaped, such that a portion of slot 624 extends circumferentially about end 620. In another embodiment, slot 624 simply extends downwardly and does not form an L shape. Generally, a width of slot 624 is the same size or larger than a width of convex portion 606.

Connector portion 222 includes body portion 630 having a first end 632 and a second end 634. In an embodiment, first end 632 has a larger diameter than a diameter of second end 634. The diameter of first end 634 is such that it will fit into, in some embodiments, snugly fit into, end 604 of trunk body 121.

In an embodiment, second end 634 defines first cylindrical cavity 640 and second cylindrical annular cavity 642. Second end 634 also includes projection 643 separating cavities 640 and 642. In an embodiment, projection 643 is a cylindrical projection.

Connector portion 222 also includes at least two electrical terminals 644 and 646 connected to wiring 206. In an embodiment, terminal 644 is located in first cavity 640 and comprises a ring terminal, cylindrical terminal, or other such contact terminal. In the embodiment depicted, electrical terminal 644 comprises a cylindrical terminal. In an alternate embodiment, electrical terminal 644 comprises a generally flat portion located at an inside bottom of cavity 640. In an embodiment, terminal 646 forms an annular ring at a bottom of cavity 642 and/or comprises a cylindrical shape within cavity 646. Generally, electrical terminals 644 and 646 are coaxial about an Axis A.

Electrical connector 222 during manufacturing assembly is inserted into, and secured end 602 of trunk body 121. Various methods may be used to secure electrical connector 222 to trunk body 121, including using a fastener that penetrates both the trunk body and the connector, thusly fastening the two components together, or using a recess/detent combination.

Electrical connector 230, in an embodiment, comprises body portion defining cavities 652 and 654, and electrical terminals 656 and 658. In an embodiment, electrical terminals 656 and 658 are coaxial about Axis A, and are electrically connected to wiring 204.

Connector 230 during manufacturing assembly is inserted into trunk body 161. In an embodiment, connector 230 is inserted beyond the end opening of trunk body 161, such that it is recessed inside trunk portion 161, such that narrow end 602 may be received by the end portion of trunk body 161 when tree 100 is assembled by a user.

When a user assembles tree 100, trunk body 161 confronts trunk body 121 to align the two bodies. Convex projection 606 is aligned with slot 624. Narrow end 602 is inserted into trunk body 161, such that convex projection 606 travels along the downward extending portion of slot 624. Second end 634 of electrical connector 222 is received by cavity 652 of electrical connector 230; electrical terminal 658 is received by cavity 642; electrical terminal 656 is received by cavity 640. Consequently, electrical terminal 656 makes electrical connection with electrical terminal 644 and electrical terminal 658 makes electrical connection with electrical terminal 646.

After narrow end 604 has been completely received by trunk body 161 and seated fully, a user may then rotate trunk bodies 121 and 161 so as to move convex projection 606 circumferentially along the circumferential (horizontal) portion of slot 624. After this rotation, trunk portion 121 (and tree portion 104) is "locked" relative to trunk portion 161 (and tree portion 106) such that any opposing forces applied to trunk portions 121 and 161 along Axis A will not separate the trunk bodies.

As such, trunk bodies 121 and 161 are keyed to one another via key/convex projection 606 and keyway/slot 624. While trunk bodies 121 and 161 are keyed and limited in their rotational orientations, electrical connectors 230 and 222 are allowed to rotate relative to one another to any degree due to their coaxial nature.

Referring to FIGS. 41-44, a two-way keyed tree trunk keying system 650 is depicted. System 650 is substantially the same as system 600, with the exception that trunk body 121 includes two convex projections, 606*a* and 606*b*, and two slots, 624*a* and 624*b*. In such a configuration, trunk body 121 may be aligned to trunk body 161 in one of two positions.

When trunk body 121 is inserted into trunk body 161 and rotated, convex projections 606 in slots 624 prevent the trunk bodies from being separated alone Axis A.

Referring to FIGS. 45-48, another embodiment of a tree trunk keying system, system 670 is depicted. System 670 is substantially similar to system 650 and system 500. In this embodiment, slot 624 is not L shaped, but rather, comprises a single linear, straight line slot, such that trunk body 121 aligns with trunk body 161 in only one rotational alignment. Further, system 670 comprises electrical connectors that are the same as those of system 500 as described above.

Referring to FIGS. 49-52, system 670*a* is substantially the same as system 670, with the exception of having two convex projections, 606*a* and 606*b*, and two slots, 624*a* and 624*b*.

Referring to FIGS. 53-64, various embodiments of tree trunk keyed systems are depicted. These further embodiments include keyed electrical connectors, but do not included keyed trunk bodies. Alignment and rotation locking of trunk and tree portions is accomplished solely via the structural keying features of the electrical connector assemblies, rather than the trunk bodies. Some users may find such systems to be easier to align and assemble since the trunk bodies do not initially have to be aligned, as described further below.

Referring specifically to FIGS. 53-56, tree trunk keying system 700 is depicted. System 700 includes trunk body 121, trunk body 161, electrical connector 22 and electrical connector 230.

Trunk body 121 includes narrow end 604 with flanged portion 608; trunk portion 161 comprises a generally circular, hollow trunk defining end 605 and interior cavity 607.

Electrical connector 222 comprises first end 702, second end 704, annular surface 706, top surface 708, electric terminals 223 and 225. Electrical connector 222 defines keyway or channel 710 extending downwardly from surface 708 towards annular surface 706. In an alternate embodiment, electrical connector 222 may also define a second keyway 710 located opposite first keyway 710.

First end 702, in an embodiment has a diameter general less than a diameter of second end 704, thusly forming annular surface 706. Electric terminals 223 and 225 in an embodiment comprise female-style electric terminals or contacts, and are embedded in second end 704 as depicted.

Electrical connector 230 includes body 720, rib or key 722, inside surface 724, top surface 726, electrical terminals 231 and 233. Body 720 defines cavity 728 configured to receive first end 702. Rib 722 extends alone inside surface 724 in a downwardly direction. Electrical terminals 231 and 233 in an embodiment comprise male electrical terminals which project upwardly within cavity 728. In an alternate embodiment, electrical connector 230 includes a second key 722 opposite first key 722.

Electrical connector 222 during manufacturing assembly is inserted into narrow end 604 of trunk body 121 and secured. In an embodiment, top surface 708 is coplanar with the very end of end 604.

Electrical connector 230 during manufacturing assembly is inserted into an end of trunk body 161. In an embodiment, electrical connector 230 is inserted a distance into trunk body 161 such that it is not adjacent an opening of the end of trunk body 161. In an alternate embodiment, electrical connector 222 is inserted into trunk body 161, and electrical connector 230 is inserted into trunk body 121.

When a user couples trunk body 121 with electrical connector 222 to trunk body 161 having electrical connector 230, trunk body 161 confronts trunk body 121 and the bodies are aligned along a vertical Axis A. Initially, no particular rotational alignment or orientation is required to fit narrow end 604 of trunk body 121 into cavity 607 of trunk body 161.

As end 604 is inserted into cavity 607, electrical contact 222 will make contact with electrical contact 230. If key 722 is aligned rotationally with keyway 710, then second end 704 of electrical connector 222 will fit into cavity 728 of electrical connector 230, and electrical connectors 222 and 230 can be fully coupled such that annular surface 706 contacts top surface 726.

If key 722 is not initially aligned with keyway 710, a user may rotate either of trunk body 121 or 161, and hence electrical connectors 222 and 230 so as to align the key and keyway. In an embodiment, a user initially inserts end 604 into cavity 607, allows key 722 to contact top surface 708 in misalignment, then rotates trunk section 161 until key 722 aligns with keyway 710 and trunk body 161 and electrical connector 230 fall downwards onto trunk body 121. The ability to couple trunk body 121 to trunk body 161 in part, followed by aligning the electrical connectors makes it easier to assemble tree 100.

In such a configuration, the electrical connectors 222 and 230 form a one-way keyed pair, while trunk bodies 121 and 161 are not keyed, and can be coupled in any orientation, the weight of tree portion 106 and trunk body 161. Alternatively, when electrical connectors 222 and 230 include pairs of keyways 710 and keys 722, respectively, system 700 forms a two-way keyed electrical connection and tree trunk connection system.

Referring to FIGS. 57-60, tree trunk keying system 760 is depicted. System 760 is substantially the same as system 700, but with a somewhat different key and keyway pair and electrical connector set.

System 760 includes trunk body 161, trunk body 121, electrical connector 222 and electrical connector 230. Trunk bodies 121 and 161 are the same as those described earlier, and can be coupled in any rotational orientation or alignment, such that they are not keyed. Electrical connector 22*s* is similar to previously-described electrical connectors 222, and includes keyway 762 extending downwardly from top surface 764 of electrical connector 222. In an embodiment, electrical connector 222 includes a second keyway 762 opposite first keyway 762.

Electrical connector 230 includes key 766 extending upward and away from top surface 768 of electrical connector 230. In an embodiment, a length of key 766 is substantially the same as, or somewhat longer than, a length of one of electrical terminals 231 or 233. In the depicted embodiment, key 766 is located generally at a periphery of top surface 768.

Figures 57, 58, 59, 60:
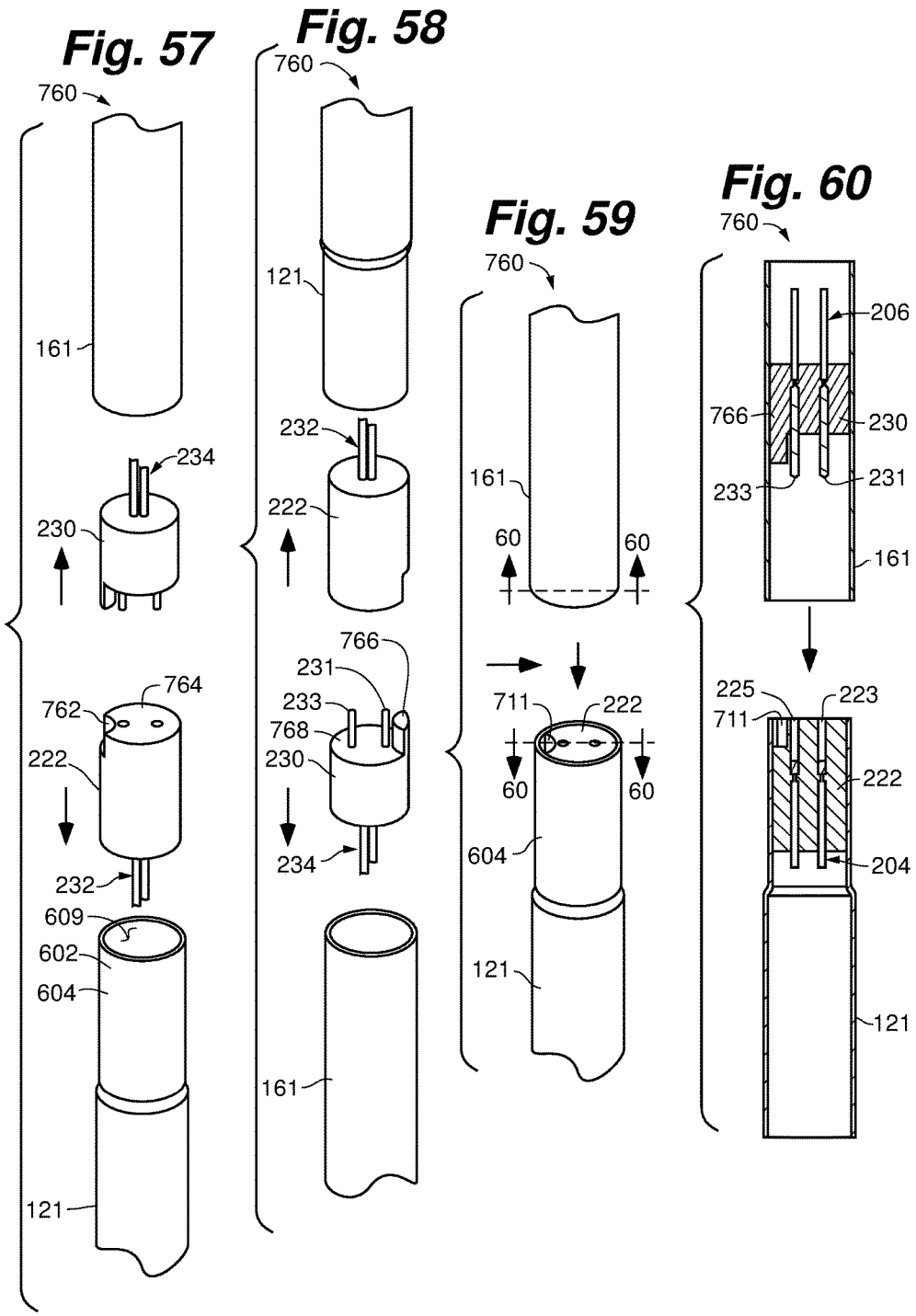
FIG. 57 depicts a pair of non-keyed trunk bodies and a pair of keyed electrical connectors, according to another embodiment of the claimed invention.
FIG. 58 depicts the pair of trunk bodies and pair of electrical connectors of FIG. 57 in an inverted view.
FIG. 59 depicts the electrical connectors of FIGS. 57 and 58 assembled into their respective trunk bodies.
FIG. 60 is a cross sectional view of the trunk bodies and electrical connectors of FIG. 59.

Electrical connector 230 is inserted into trunk body 161; electrical connector 222 is inserted into trunk body 121. When electrical connector 222 is inserted into trunk body 121, a portion of trunk body wall 602, and an inside surface 609 cooperate with keyway 762 to form a multi-sided keyway for key 766. Such a multi-sided keyway is depicted in FIG. 59 as reference numeral 711.

Similar to system 700, system 760 provides a one-way or two-way keyed electrical connection and tree trunk connection system that prevents rotation of tree trunk sections and tree portions relative to one another, thusly protecting the aesthetics of a decorated or lighted tree, while preserving the integrity of any light strings on the tree.

Referring to FIGS. 61-64 another embodiment of a tree trunk keying system, system 780, is depicted. System 780 is substantially similar to system 760 as depicted in FIGS. 57-60, with the exception of the key and keyway.

System 780 includes key 782 in electrical connector 230 and keyway 784 in electrical connector 222. In an embodiment, and as depicted, key 782 forms a projection portion projecting upwardly and away from surface 768 of electrical connector 230. A height of key 782 is approximately the same as a height of electrical terminal 231 or 233, though in other embodiments, a height of key 782 may be longer so as to provide some degree of protection to electrical terminals 231 and 233, or in other embodiments, may be shorter than terminals 231 or 233. In an embodiment, key 782 is generally cylindrical with a convex, rounded tip. Such a rounded tip makes it easier for a user to locate key 782 into keyway 784.

In an embodiment, key 782 is positioned in a non-central location with respect to surface 764. In one such embodiment, key 782 is located centrally along a left-to-right axis, but non-central along a front-to-back axis, as depicted in FIG. 161. In an alternate embodiment, key 782 is located in the center of surface 768 of electrical connector 230.

In an embodiment, electrical terminals 231 and 233 extend upwardly and away from surface 768, and are positioned generally opposite one another. In an embodiment, terminal 231, terminal 233, and key 785 are spaced apart to form a triangular area between themselves, as depicted in FIG. 62. In embodiment, terminal 231, terminal 233 and key 782 are equidistant one another, and may have equal heights, which may aid a user in coupling connectors 222 and 230.

Further, the use of a keyway that is thicker and less susceptible to bending, as compared to terminals 231 and 233 minimizes the likelihood of terminals 231 or 233 being bent when electrical connectors 222 and 230 are coupled.

Keyway 784 is generally complementary and positioned and sized to receive key 782. As depicted, keyway 784 is generally circular so as to receive key 782. As depicted, and in an embodiment, keyway 784 is non-centrally located with respect to surface 764, and may be equidistantly spaced apart from electrical terminals 223 and 225.

The various embodiments of tree trunk keying systems as described and depicted above provide a number of features to enhance the assembly, safety, and operation of modern, multi-sectional artificial trees, including modular lighted trees of the claimed invention.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A keyed, rotation-locking artificial tree, the tree comprising:

a first tree portion defining a first central vertical axis, including:

a first generally cylindrical trunk body aligned along the first central vertical axis and defining a first end and a second end, a first electrical connector adjacent the first end of the first trunk body, the first electrical connector including a first non-conductive connector body defining a first outer surface and including a non-conductive projection portion, a first conductive electrical terminal and a second conductive electrical terminal, the non-conductive projection portion radially displaced from the first central vertical axis, located at a periphery of the first non-conductive connector body, and projecting from the periphery of the first non-conductive connector body, thereby forming a first key of the first electrical connector;

a first set of electrical wires at least partially inside the first generally cylindrical trunk body and electrically connected to the first and second electrical terminals of the first electrical connector;

a first plurality of branches connected to the first generally cylindrical trunk body by a first plurality of first branch support structures, each of the first plurality of branches pivotable about one of the first plurality of first branch support structures, the first plurality of branches including a first branch connected to the first trunk body at a first location of the first trunk body and a second branch connected to the first trunk body at a second location, the first location axially displaced from the second location such that the first branch and the second branch are also axially displaced from one another;

a first light string wrapped about the first plurality of branches, including wrapped about the first branch and the second branch, the first light string comprising first light-string wiring and a first plurality of light-element assemblies, the first light string wiring electrically connected to the first set of electrical wires, each light-element assembly including a light element comprising a light-emitting diode (LED), the plurality of light-element assemblies electrically connected in a series-parallel configuration and having multiple groups of LEDs, the LEDs of each of the multiple groups being electrically connected in a parallel configuration;

a second tree portion defining a second central vertical axis and configured to couple to the first tree portion such that the first and second central vertical axes are aligned, the second tree portion including:

a second generally cylindrical trunk body aligned along the second central vertical axis and defining a first end and a second end, the second end of the second generally cylindrical trunk body configured to couple to the first end of the first generally cylindrical trunk body of the first tree portion;

a second electrical connector adjacent the second end of the second trunk body, the second electrical connector including a second non-conductive connector body defining a projection-receiving portion configured to receive the non-conductive projection portion of the first electrical connector to thereby form a first keyway in the second non-conductive connector body, a third conductive electrical terminal and a fourth conductive electrical terminal, the third and fourth conductive electrical terminals projecting axially and supported by the second non-conductive connector body, a second set of electrical wires at least partially inside the second generally cylindrical trunk body and electrically connected to the third and fourth electrical terminals of the second electrical connector;

a second plurality of branches connected to the second generally cylindrical trunk body by a second plurality of second branch support structures, each of the second plurality of branches pivotable about one of the second plurality of second branch support structures, the second plurality of branches including a third branch connected to the second trunk body at a third location of the second trunk body and a fourth branch connected to the second trunk body at a fourth location, the third location axially displaced from the fourth location such that the third branch and the fourth branch are also axially displaced from one another;

a second light string wrapped about the second plurality of branches, including wrapped about the third branch and the fourth branch, the second light string comprising second light-string wiring and a second plurality of light-element assemblies;

wherein the first electrical terminal of the first electrical connector is configured to connect with the third electrical terminal of the second electrical connector to make electrical connection with the third electrical terminal of the second electrical connector, and the second electrical terminal of the first electrical connector is configured to connect with the fourth electrical terminal of the second electrical connector to make electrical connection with the fourth electrical terminal of the second electrical connector, when the first tree portion and the second tree portion are coupled together, thereby electrically connecting the first tree portion to the second tree portion, and the non-conductive projection portion of the first electrical connector is received by the projection-receiving portion of the second electrical connector, thereby inserting the first key of the first tree portion into the first keyway of the second tree portion and preventing rotation of the first tree portion relative to the second tree portion.

2. The keyed, rotation-locking artificial tree of claim 1, further comprising a third three portion coupled to the second tree portion, wherein the second light string is wrapped about branches of the third tree portion.

3. The keyed, rotation-locking artificial tree of claim 1, wherein the first light-string wiring of the first light string is not twisted about itself.

4. The keyed, rotation-locking artificial tree of claim 1, wherein the non-conductive projection portion includes an arcuate portion defining a curvature that is substantially the same as the curvature of an outer circumferential surface of the first non-conductive connector body.

5. The keyed, rotation-locking artificial tree of claim 1, wherein the first tree portion includes a second key and the second tree portion includes a second keyway configured to receive the second key of the first tree portion.

6. The keyed, rotation-locking artificial tree of claim 5, wherein a first trunk wall of the first generally cylindrical trunk body forms the second key and a second trunk wall of the second generally cylindrical trunk body forms the second keyway.

7. The keyed, rotation-locking artificial tree of claim 1, wherein each of the first and the second conductive electrical terminals are radially displaced from the first central vertical axis.

8. The keyed, rotation-locking artificial tree of claim 1, wherein the first outer surface is a radially-extending outer surface, and the non-conductive projection portion projects transversely to the radially-extending surface in an axial direction.

9. A keyed, rotation-locking artificial tree, the tree comprising:

a first tree portion defining a first central vertical axis, including:

a first generally cylindrical trunk body aligned along the first central vertical axis and defining a first end, a second end, and a radius, the first generally cylindrical trunk body including a first trunk wall;

an axially-extending first key portion located adjacent to the first end of the first generally cylindrical trunk body and radially displaced a radial distance from the first central vertical axis, the radial distance being greater than the radius of the first generally cylindrical trunk body;

a first electrical connector adjacent the first end of the first trunk body, the first electrical connector including a first non-conductive connector body, a first conductive electrical terminal and a second conductive electrical terminal, the first and second conductive electrical terminals projecting axially and connected to the first non-conductive connector body;

a first set of electrical wires at least partially inside the first generally cylindrical trunk body and electrically connected to the first and second electrical terminals of the first electrical connector;

a first plurality of branches pivotally connected to the first generally cylindrical trunk body;

a first light string wrapped about the first plurality of branches and including first light-string wiring and a first plurality of light-element assemblies, a second tree portion defining a second central vertical axis and configured to couple to the first tree portion such that the first and second central vertical axes are aligned, the second tree portion including:

a second generally cylindrical trunk body aligned along the second central vertical axis and defining a first end and a second end, the second generally cylindrical trunk body including a second trunk wall, the second end of the second generally cylindrical trunk body configured to couple to the first end of the first generally cylindrical trunk body of the first tree portion such that the first trunk wall and the second trunk wall are overlapping;

a first keyway of the second tree portion located adjacent to the second end of the second generally cylindrical trunk body configured to receive the axially-extending first key portion of the first tree portion, wherein the first keyway encircles the axially-extending first key portion upon insertion of the first key portion into the first keyway, thereby preventing rotation of the first tree portion relative to the second tree portion;

a second electrical connector adjacent the second end of the second trunk body, the second electrical connector including a second non-conductive connector body, a third conductive electrical terminal and a fourth conductive electrical terminal, the third and fourth conductive electrical terminals configured to respectively connect with the first and second conductive electrical terminals;

a second set of electrical wires at least partially inside the second generally cylindrical trunk body and electrically connected to the third and fourth electrical terminals of the second electrical connector;

a second plurality of branches connected to the second generally cylindrical trunk body a second light string wrapped about the second plurality of branches and including second light-string wiring and a second plurality of light-element assemblies;

wherein the first electrical terminal of the first electrical connector is configured to make electrical connection with the third electrical terminal of the second electrical connector, and the second electrical terminal of the first electrical connector is configured to make electrical connection with the fourth electrical terminal of the second electrical connector, when the first tree portion and the second tree portion are coupled together, thereby electrically connecting the first tree portion to the second tree portion.

10. The keyed, rotation-locking artificial tree of claim 9, wherein the first plurality of branches are pivotally connected to the first generally cylindrical trunk body by a first plurality of first branch support structures, each of the first plurality of branches pivotable about one of the first plurality of first branch support structures, the first plurality of branches including a first branch connected to the first trunk body at a first location of the first trunk body and a second branch connected to the first trunk body at a second location, the first location axially displaced from the second location such that the first branch and the second branch are also axially displaced from one another, and the first light string extends from the first branch to the second branch.

11. The keyed, rotation-locking artificial tree of claim 10, wherein each light-element assembly of the first plurality of light assemblies includes a light element comprising a light-emitting diode (LED), the plurality of light-element assemblies electrically connected in a series-parallel configuration and having multiple groups of LEDs, the LEDs of each of the multiple groups being electrically connected in a parallel configuration.

12. The keyed, rotation-locking artificial tree of claim 9, wherein the first tree portion includes a second key portion and the second tree portion includes a second keyway configured to receive the second key portion of the first tree portion.

13. The keyed, rotation-locking artificial tree of claim 12, wherein the first trunk wall of the first generally cylindrical trunk body forms the second key portion and the second trunk wall of the second generally cylindrical trunk body forms the second keyway.

14. The keyed, rotation-locking artificial tree of claim 9, wherein each of the first and the second conductive electrical terminals are radially displaced from the first central vertical axis.

15. A keyed, rotation-locking artificial tree, the tree comprising:

a first tree portion defining a first central vertical axis, including:

a first generally cylindrical trunk body aligned along the first central vertical axis and defining a first end and a second end, the first generally cylindrical trunk body including a first trunk wall;

a first electrical connector adjacent the first end of the first trunk body, the first electrical connector including a first non-conductive connector body including a first arcuate projection portion and a second arcuate projection portion, a first conductive electrical terminal and a second conductive electrical terminal, the first and second conductive electrical terminals projecting from the first non-conductive connector body in an axial direction, the first and second arcuate projection portions, thereby forming respective first and second keys of the first electrical connector;

a first set of electrical wires at least partially inside the first generally cylindrical trunk body and electrically connected to the first and second electrical terminals of the first electrical connector;

a first plurality of branches connected to the first generally cylindrical trunk body, a first light string wrapped about the first plurality of branches and comprising first light-string wiring and a first plurality of light-element assemblies, the first light string wiring electrically connected to the first set of electrical wires, a second tree portion defining a second central vertical axis and configured to couple to the first tree portion such that the first and second central vertical axes are aligned, the second tree portion including:

a second generally cylindrical trunk body aligned along the second central vertical axis and defining a first end and a second end, the second generally cylindrical trunk body including a second trunk wall, the second end of the second generally cylindrical trunk body configured to couple to the first end of the first generally cylindrical trunk body of the first tree portion such that the first trunk wall and the second trunk wall are overlapping;

a second electrical connector adjacent the second end of the second trunk body, the second electrical connector including a second non-conductive connector body defining a first arcuate projection-receiving portion configured to receive the first arcuate projection of the first electrical connector and a second arcuate projection-receiving portion configured to receive the second arcuate projection of the first electrical connector to thereby forming first and second keyways in the second non-conductive connector body, a third conductive electrical terminal and a fourth conductive electrical terminal, the third and fourth conductive electrical terminals configured to respectively make contact with the first and second conductive electrical terminals;

a second set of electrical wires at least partially inside the second generally cylindrical trunk body and electrically connected to the third and fourth electrical terminals of the second electrical connector;

a second plurality of branches pivotally connected to the second generally cylindrical trunk;

a second light string wrapped about the second plurality of branches;

wherein the first electrical terminal of the first electrical connector is configured to make electrical connection with the third electrical terminal of the second electrical connector, and the second electrical terminal of the first electrical connector is configured to make electrical connection with the fourth electrical terminal of the second electrical connector, when the first tree portion and the second tree portion are coupled together, thereby electrically connecting the first tree portion to the second tree portion, and the first and second keys of the first tree portion are received by the first and second keyways of the second tree portion when the first tree portion and the second tree portion are coupled together, thereby preventing rotation of the first tree portion relative to the second tree portion.

16. The keyed, rotation-locking artificial tree of claim 15, wherein the first plurality of branches are pivotally connected to the first generally cylindrical trunk body by a first plurality of first branch support structures, each of the first plurality of branches pivotable about one of the first plurality of first branch support structures, the first plurality of branches including a first branch connected to the first trunk body at a first location of the first trunk body and a second branch connected to the first trunk body at a second location, the first location axially displaced from the second location such that the first branch and the second branch are also axially displaced from one another, and the first light string extends from the first branch to the second branch.

17. The keyed, rotation-locking artificial tree of claim 15, wherein the first trunk wall of the first generally cylindrical trunk body forms a third key of the first tree portion and the second trunk wall of the second generally cylindrical trunk body forms a third keyway of the second tree portion.

18. The keyed, rotation-locking artificial tree of claim 15, wherein each light-element assembly of the first plurality of light assemblies includes a light element comprising a light-emitting diode (LED), the plurality of light-element assemblies electrically connected in a series-parallel configuration and having multiple groups of LEDs, the LEDs of each of the multiple groups being electrically connected in a parallel configuration.

* * * * *